US009782968B2

(12) United States Patent
Tobita

(10) Patent No.: US 9,782,968 B2
(45) Date of Patent: Oct. 10, 2017

(54) DROPLET DISCHARGING APPARATUS, METHOD OF CONTROLLING DROPLET DISCHARGING APPARATUS AND IMAGE FORMING APPARATUS INCLUDING DROPLET DISCHARGING APPARATUS

(71) Applicant: Katsuhiro Tobita, Kanagawa (JP)

(72) Inventor: Katsuhiro Tobita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/063,747

(22) Filed: Mar. 8, 2016

(65) Prior Publication Data

US 2016/0271943 A1 Sep. 22, 2016

(30) Foreign Application Priority Data

Mar. 19, 2015 (JP) ..... 2015-056819

(51) Int. Cl.
*B41J 2/045* (2006.01)
*B41J 2/165* (2006.01)

(52) U.S. Cl.
CPC ..... *B41J 2/04581* (2013.01); *B41J 2/1652* (2013.01); *B41J 2/16508* (2013.01); *B41J 2/16523* (2013.01); *B41J 2/16585* (2013.01)

(58) Field of Classification Search
CPC ... B41J 2/04581; B41J 2/0451; B41J 2/04588
See application file for complete search history.

(56) References Cited

U.S. PATENT DOCUMENTS 5,164,740 A * 11/1992 Ivri ..... B41J 2/04 346/139 C
7,300,131 B2 * 11/2007 Sakagami ..... B41J 2/0451 347/19
8,100,500 B2 1/2012 Bansyo
2011/0063351 A1 * 3/2011 Kitaoka ..... B41J 2/04581 347/11

(Continued)

FOREIGN PATENT DOCUMENTS

JP 2009-274360 11/2009
JP 2011-183617 9/2011
JP 2011-189655 9/2011

*Primary Examiner* — Stephen Meier
*Assistant Examiner* — John P Zimmermann
(74) *Attorney, Agent, or Firm* — IPUSA, PLLC

(57) ABSTRACT

A droplet discharging apparatus includes a recording head that includes pressure chambers, piezoelectric elements, and an in-head reservoir, provided near the pressure chambers; a liquid circulation unit that includes a liquid reservoir and circulates liquid between the in-head reservoir and the liquid reservoir; a drive waveform generation unit that generates a drive waveform that drives each of the piezoelectric elements; a remaining oscillation detection unit that detects remaining oscillation generated in at least one of the pressure chambers after driving the respective piezoelectric element; a status determining unit that determines a sedimentation status of a component in liquid in the in-head reservoir based on the detected remaining oscillation; and a control unit that controls a liquid circulation operation of the liquid circulation unit in order to dissolve the sedimentation status of the component in the liquid in the in-head reservoir based on the determined sedimentation status.

15 Claims, 16 Drawing Sheets

(56) References Cited

U.S. PATENT DOCUMENTS

| | | | | |
|---|---|---|---|---|
| 2012/0174896 | A1* | 7/2012 | Kuchler | F02D 41/2096 123/494 |
| 2012/0249638 | A1* | 10/2012 | Takano | B41J 2/0454 347/10 |
| 2015/0062226 | A1* | 3/2015 | Otokita | B41J 2/0451 347/14 |
| 2015/0258780 | A1 | 9/2015 | Hayashi | |
| 2015/0352841 | A1 | 12/2015 | Horie | |
| 2015/0367633 | A1 | 12/2015 | Murate | |

* cited by examiner

DROPLET DISCHARGING APPARATUS, METHOD OF CONTROLLING DROPLET DISCHARGING APPARATUS AND IMAGE FORMING APPARATUS INCLUDING DROPLET DISCHARGING APPARATUS

BACKGROUND OF THE INVENTION

1. Field of the Invention

The present invention relates to a droplet discharging apparatus, a method of controlling a droplet discharging apparatus and an image forming apparatus including a droplet discharging apparatus.

2. Description of the Related Art

An inkjet printer is widely known as an image forming apparatus in which ink is injected on a recording medium. Such an inkjet printer includes a recording head, and prints on a recording medium by discharging ink droplets from nozzles formed at the recording head toward the recording medium. Further, an inkjet printer is known that includes a unit capable of discharging a special color ink (white, for example) or a magnetic material ink in addition to general YMCK inks.

For ink used for such an inkjet printer (printer apparatus), a dye ink and a pigment ink are used. The pigment ink has a feature that it is brightly colored as the pigment ink uses pigment as colorant and the pigment is dispersed in ink solvent. However, there is a problem that the colorant sediments if the pigment ink is left for a long time.

Further, the pigment ink includes a white ink that is known to have strong tendency that pigment sediments because the specific gravity of titanium oxide, which is the pigment of the white ink, is large. Further, among ink kinds, a magnetic material ink is known that includes a magnetic material and is mainly used for printing bank checks or the like. Similarly, the magnetic material tends to sediment because the specific gravity of the magnetic material is large. Such inks in which segmentations tend to occur are referred to as "sedimentary inks", hereinafter. If the sedimentary ink is left, physical property values (viscosity or the like) of the ink change because the ink cannot retain a normal condition in which the pigment is uniquely mixed. As a result, a printing failure occurs due to lowering of discharging characteristics, or lowering of image quality such as the concentration is not uniform occurs.

Thus, a technique is known in which remaining oscillation after supplying a drive signal to a piezoelectric element is detected to estimate ink viscosity, and a recovery process is performed (Patent Document 1). In this example, as illustrated in FIG. 22, an oscillation period Tc of the remaining oscillation is measured, and a period Ts from a timing when supplying of a drive signal to a piezoelectric element is finished to a timing when a remaining oscillation waveform exceeds a reference voltage Vref is detected. Then, a peak value Em of the remaining oscillation waveform of a first half-wave is obtained based on a ratio Ts/Tc of the oscillation period Tc and the period Ts, and the reference voltage Vref, and the viscosity of the ink is determined based on the obtained peak value Em.

Further, an inkjet printer is disclosed that includes an ink circulation path in which an inkjet head, a first tank that supplies ink to the inkjet head and a second tank that collects the ink that is not consumed at the inkjet head are provided. The inkjet printer further includes a maintenance unit that performs a maintenance operation accompanied with consumption of ink, a measurement unit that obtains a flow channel resistance when ink flows from the first tank to the second tank via the inkjet head, and a control unit that selects an maintenance operation by which the ink is circulated in the ink circulation path without accompanying the consumption of the ink by the maintenance unit (Patent Document 2).

However, according to the technique of Patent Document 1, as will be explained later, there is a problem that slight change of the viscosity of the ink cannot be detected because variation of ON resistor/ON time of a switching unit directly influences on the above described period Ts and the peak value Em of the first half-wave varies largely.

Further, according to the inkjet printer of Patent Document 2, as the flow channel resistance is obtained by measuring the period necessary for the ink to flow from the first tank to the second tank, it is necessary to drive a pump for circulating the ink after a predetermined period for obtaining the flow channel resistance has passed. Further, the pump is driven after the predetermined period has passed regardless of the viscosity of the ink. Thus, there is a problem that the pump is always periodically driven and power consumption is increased.

PATENT DOCUMENTS

[Patent Document 1] Japanese Laid-open Patent Publication No. 2011-189655

[Patent Document 2] Japanese Laid-open Patent Publication No. 2009-274360

SUMMARY OF THE INVENTION

The present invention is made in light of the above problems, and provides a droplet discharging apparatus capable of detecting a sedimentation status of ink pigment in various sedimentary inks, and reducing electrical energy consumption and ink consumption.

According to an embodiment, there is provided a droplet discharging apparatus including a recording head that includes a plurality of pressure chambers that communicate with a plurality of nozzles, respectively, each of the pressure chambers reserving liquid, an oscillation plate provided over the pressure chambers to form an elastic wall of each of the pressure chambers, a plurality of piezoelectric elements provided to face the pressure chambers, respectively, via the oscillation plate, and an in-head reservoir, provided near the pressure chambers, that supplies liquid to the pressure chambers; a liquid circulation unit that includes a liquid reservoir that reserves liquid, and a liquid transporting pipe that transports liquid between the in-head reservoir of the recording head and the liquid reservoir, the liquid circulation unit circulating liquid between the in-head reservoir and the liquid reservoir; a drive waveform generation unit that generates a drive waveform that drives each of the piezoelectric elements; a remaining oscillation detection unit that detects remaining oscillation generated in at least one of the pressure chambers after driving the respective piezoelectric element; a status determining unit that determines a sedimentation status of a component in liquid in the in-head reservoir based on the remaining oscillation detected by the remaining oscillation detection unit; and a control unit that controls a liquid circulation operation of the liquid circulation unit in order to dissolve the sedimentation status of the component in the liquid in the in-head reservoir based on the sedimentation status determined by the status determining unit.

BRIEF DESCRIPTION OF THE DRAWINGS

Other objects, features and advantages of the present invention will become more apparent from the following detailed description when read in conjunction with the accompanying drawings.

FIG. 6A and FIG. 6B are views schematically illustrating generation of remaining oscillation at a printing nozzle wherein FIG. 6A illustrates change of pressure generated in an individual pressure generation chamber when discharging ink and FIG. 6B illustrates change of pressure generated in the individual pressure generation chamber after the ink is discharged;

DETAILED DESCRIPTION OF THE PREFERRED EMBODIMENTS

Figure 1:
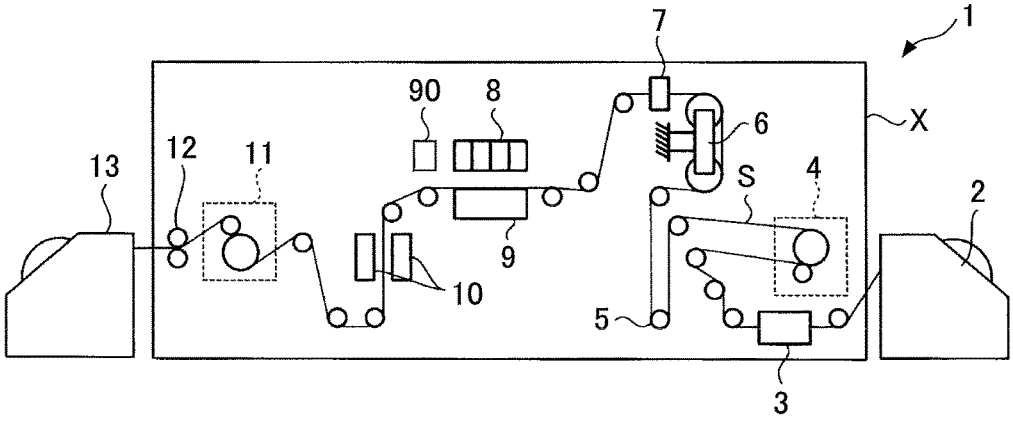
FIG. 1 is a view schematically illustrating a structure of an on-demand line scanning inkjet recording apparatus.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

FIG. 1 is a view schematically illustrating a structure of an on-demand line scanning inkjet recording apparatus (image forming apparatus). The inkjet recording apparatus 1 includes an inkjet recording apparatus body X, a recording medium supplying unit 2 and a recording medium collecting unit 13.

The inkjet recording apparatus body X includes a regulation guide 3, an inner feed unit 4, a dancer roller 5, an Edge Position Controller (EPC) 6, a meandering amount detector 7, an inkjet recording module 8, a platen 9, a drying module 10, an out feed unit 11 and a puller 12.

The regulation guide 3 determines a position of a recording medium S in a width direction. The inner feed unit 4 includes a drive roller and a driven roller for retaining the tension of the recording medium S constant. The dancer roller 5 moves upward and downward in accordance with the tension of the recording medium S and outputs a position signal. The EPC 6 controls an edge portion of the recording medium S. The platen 9 is provided to face the inkjet recording module 8. The out feed unit 11 includes a drive roller and a driven roller for conveying the recording medium S at a set speed. The puller 12 includes a drive roller and a driven roller for ejecting the recording medium S outside the inkjet recording apparatus body X.

The inkjet recording module 8 includes line heads in each of which printing nozzles 16 (discharging ports, see FIG. 4) are provided across a printing width. Color printing is performed by line heads of black, cyan, magenta and yellow. When printing, a nozzle surface of each of the line heads is supported on the platen 9 while having a predetermined space from the platen 9. A color image is formed on the recording medium S when the inkjet recording module 8 discharges ink in accordance with a conveying speed of the recording medium S.

By using the line scanning inkjet recording apparatus 1, high speed image formation can be performed.

Figure 2:
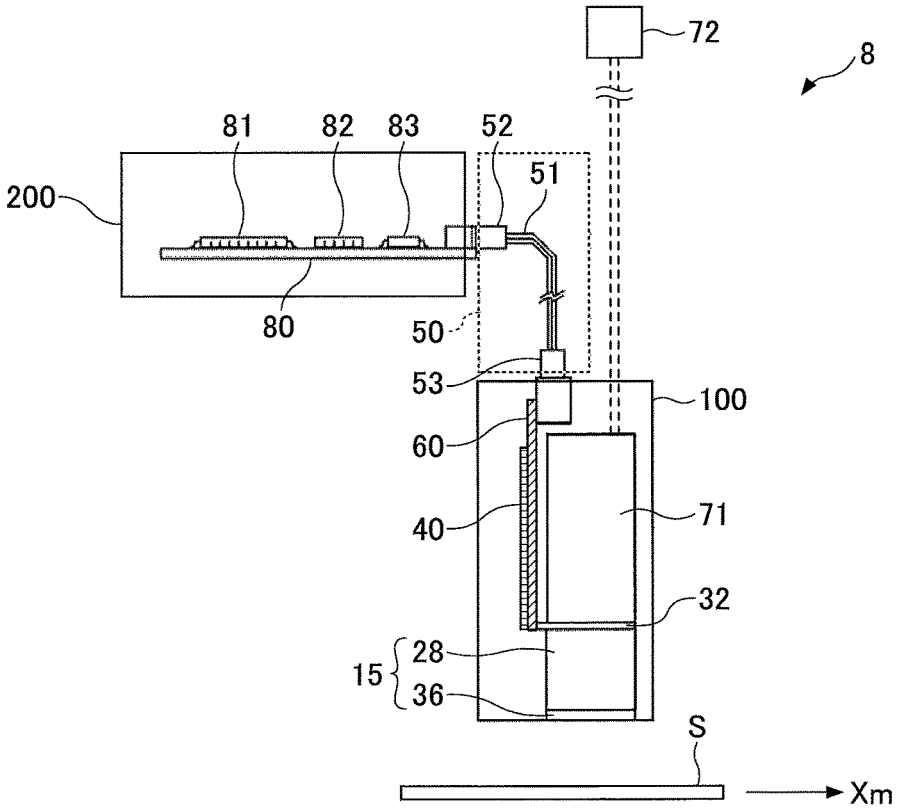
FIG. 2 a side view illustrating a structure of an inkjet recording module.

FIG. 2 is a side view illustrating a structure of the inkjet recording module 8. The inkjet recording module 8 mainly includes a drive control unit 200, an inkjet recording head apparatus 100 (recording head apparatus) and a connecting unit 50.

The drive control unit 200 includes a drive control substrate 80 on which a control unit 81, a drive waveform generation unit 82 and a storage unit 83 are mounted, which will be explained in detail later with reference to FIG. 10.

The connecting unit 50 includes a cable 51 to which a drive control substrate side connector 52 and a head side connector 53 are attached. The connecting unit 50 performs analog signal and digital signal communication between the drive control substrate 80 and a head substrate 60 included in the recording head apparatus 100.

The recording head apparatus 100 includes, as a control system, the head substrate 60, a remaining oscillation detection substrate 40 and a piezoelectric element supporting substrate 32 (head drive IC substrate). Further, the recording head apparatus 100 includes a plurality of recording heads 15 (referred to as an "inkjet recording head unit" or a "piezoelectric droplet discharge head" as well) for discharging ink. The recording head 15 includes a rigid plate 28 that houses piezoelectric elements 31 (see FIG. 5), and a flow channel plate 36 in which the printing nozzles 16 and individual pressure generation chambers 20 (see FIG. 5) are formed (see FIG. 5). An ink tank (in-head ink tank) 71 that reserves ink is provided in the recording head apparatus 100 near the recording head 15.

The line scanning inkjet recording apparatus 1 has a line head structure in which the recording heads 15 are aligned in a depth direction of FIG. 2, in other words, a direction perpendicular to a conveying direction Xm of the recording medium S.

However, the present embodiment is not limited to the above described line scanning structure, and a serial scanning printer in which an image is formed by moving one or more of the recording heads 15 in the depth direction, in other words, the direction perpendicular to the conveying direction Xm of the recording medium S while conveying the recording medium S in the conveying direction Xm, or other droplet discharging apparatuses or the like may be used.

Figure 3:
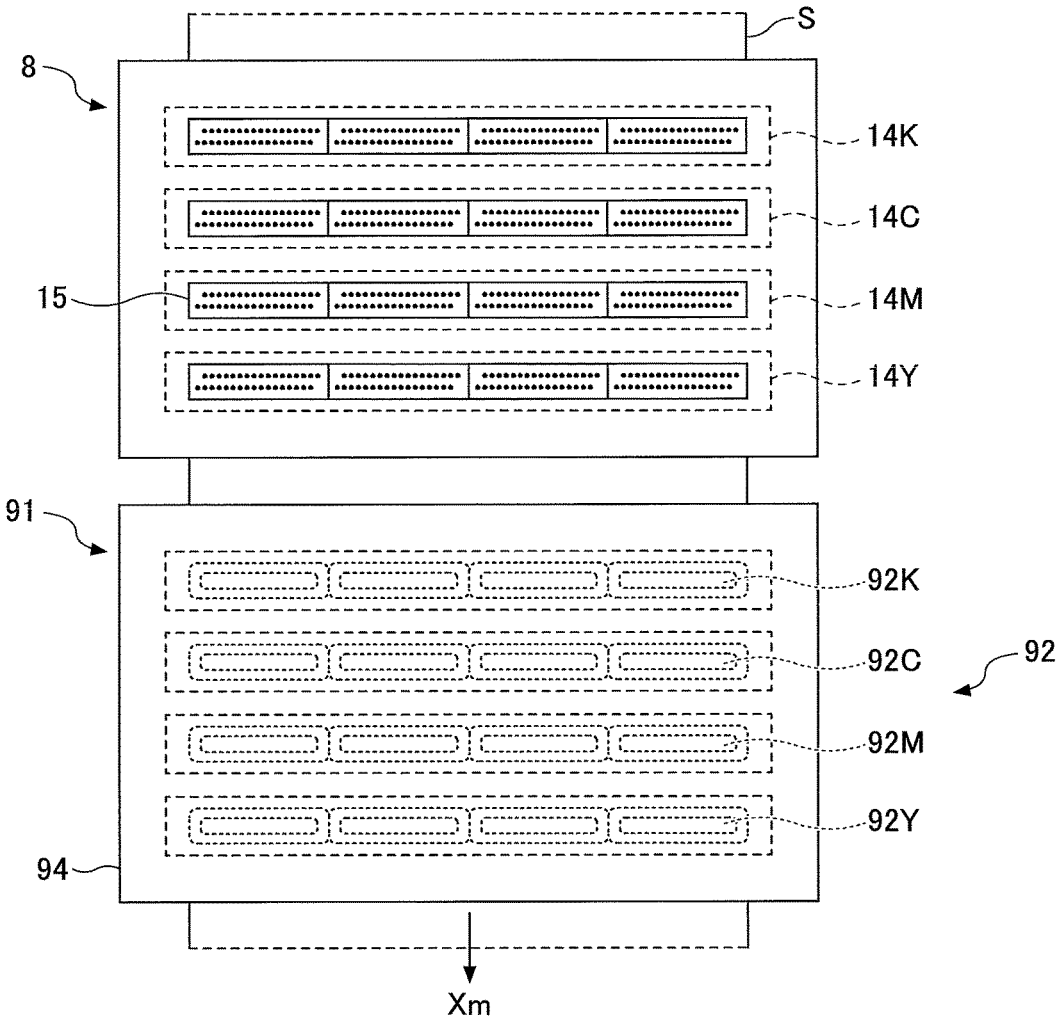
FIG. 3 is a bottom view schematically illustrating the inkjet recording head module having a line head structure and cap members of a maintenance and recovery mechanism.

FIG. 3 is a bottom view schematically illustrating the inkjet recording head module 8 having the line head structure, and cap members 92 of the maintenance and recovery mechanism 90 (maintenance and recovery unit). The recording head module 8 illustrated in FIG. 3 is configured with an aggregation of four head arrays 14K, 14C, 14M and 14Y. The head array for black 14K discharges black ink droplets, the head array for cyan 14C discharges cyan ink droplets, the head array for magenta 14M discharges magenta ink droplets and the head array 14Y for yellow discharges yellow ink droplets.

Each of the head arrays 14K, 14C, 14M and 14Y extends in the direction perpendicular to the conveying direction Xm of the recording medium S such as a paper or the like. By arraying the heads as such, a wide width of a printing area is ensured.

Further, as will be explained later with reference to FIG. 16 and FIG. 17 in detail, the maintenance and recovery mechanism 90 includes an engaging unit 91. The engaging unit 91 includes a supporting member 94 and the cap members 92 (also illustrated as 92K, 92C, 92M and 92Y) that are aligned to correspond to the head arrays 14K, 14C, 14M and 14Y, respectively. Although the cap members 92 are schematically illustrated in FIG. 3, actually, the cap members 92K, 92C, 92M and 92Y are positioned on the supporting member 94. When the engaging unit 91 moves, the cap members 92K, 92C, 92M and 92Y are capable of associating with the printing nozzles 16 of each of the recording heads 15 of the head arrays 14K, 14C, 14M and 14Y, respectively, from downside of the nozzle surface 17 (see FIG. 4, FIG. 16 and FIG. 17). The maintenance and recovery mechanism 90 is described later in detail with reference to FIG. 15 to FIG. 17.

Figure 4:
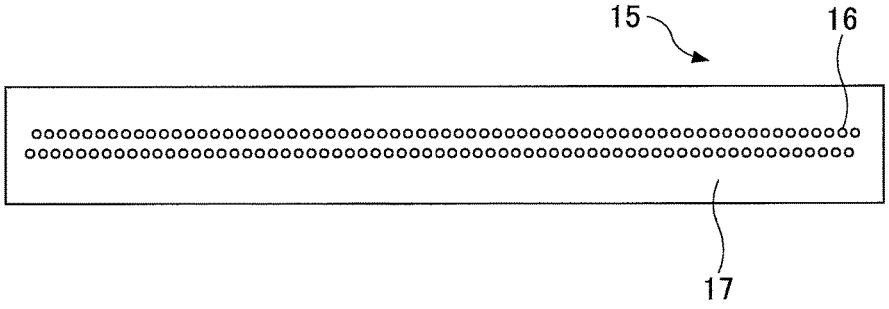
FIG. 4 is an enlarged view of a bottom surface of a recording head of FIG. 3.

FIG. 4 is an enlarged view of the bottom surface of the recording head 15 of FIG. 3. A plurality of printing nozzles 16 are aligned at a nozzle surface (bottom surface) 17 of the recording head 15 in a staggered manner. In this embodiment, two lines of the printing nozzles 16, each line including 64 nozzles, are aligned in a staggered manner. By aligning the plurality of printing nozzles 16 in a zigzag manner, the recording head 15 can correspond to high resolution.

Figure 5:
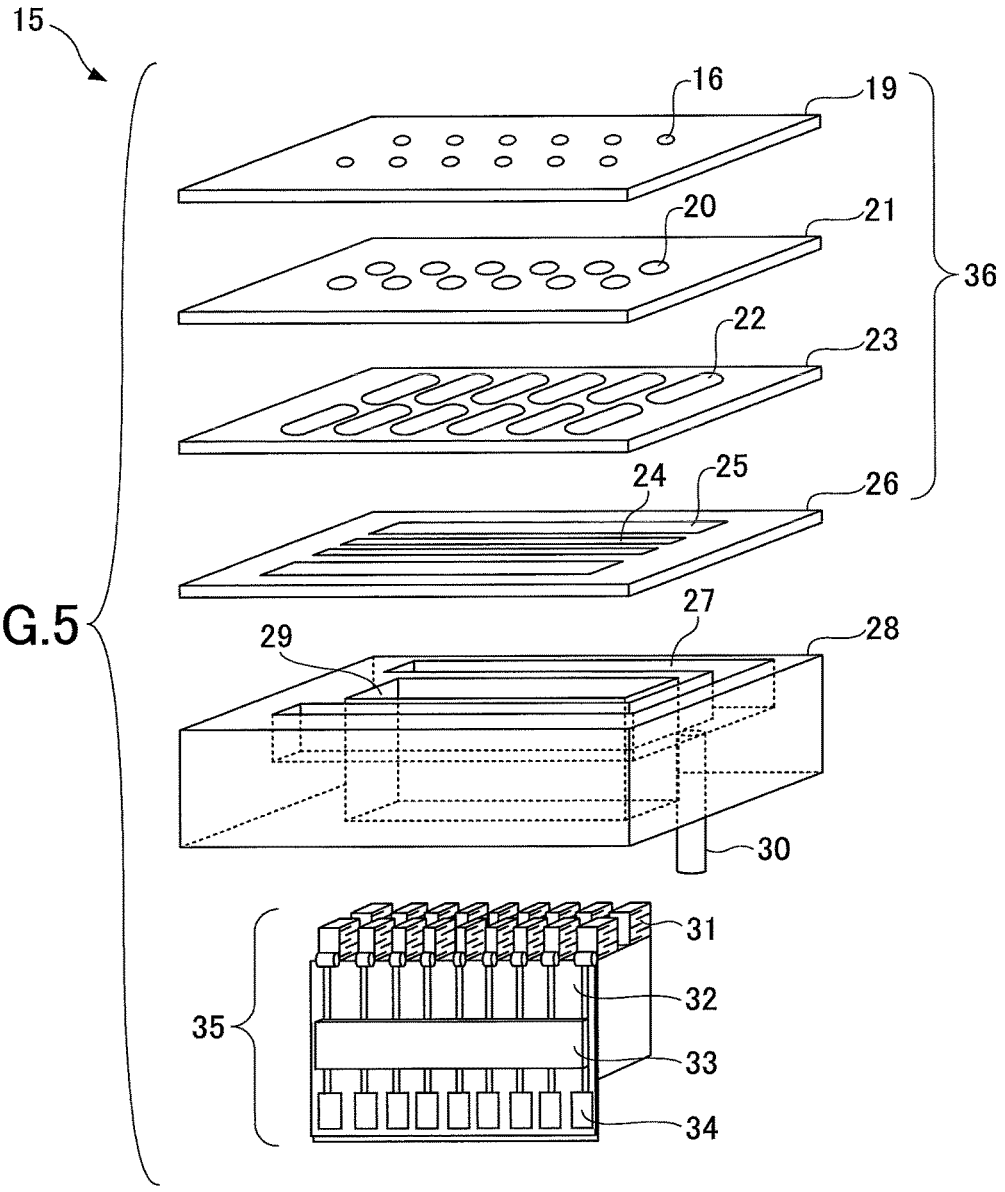
FIG. 5 perspective view illustrating a structure of the recording head.

FIG. 5 is a perspective view illustrating a structure of the recording head 15. The recording head 15 mainly includes a flow channel plate 36, a rigid plate 28 and a group of piezoelectric elements 35.

The flow channel plate 36 is configured with a diaphragm plate 26, a restrictor plate 23, a pressure chamber plate 21 and a nozzle plate 19 stacked in this order while aligning the positions and bonded with each other. The nozzle plate 19 is provided with the plurality of printing nozzles 16 aligned in a staggered manner. The pressure chamber plate 21 is provided with a plurality of individual pressure generation chambers (liquid chambers) 20 corresponding to the printing nozzles 16, respectively. The restrictor plate 23 is provided with restrictors 22 that connects a common ink flow channel 27 of the rigid plate 28 and the individual pressure generation chambers 20, respectively, for controlling the ink flow rate of the ink to the individual pressure generation chambers 20. The diaphragm plate 26 includes oscillation plates 24 and filters 25.

The flow channel plate 36 is bonded to the rigid plate 28 such that the filters 25 face an open portion of the common ink flow channel 27.

The group of piezoelectric elements 35 configured with a plurality of aligned piezoelectric elements 31 is attached to the rigid plate 28. The recording head 15 is structured by inserting the group of piezoelectric elements 35 to an open portion 29 of the rigid plate 28, and bonding and fixing free ends of the piezoelectric elements 31 to the oscillation plate 24.

Piezoelectric element drive ICs (head drive ICs) 33 are mounted on the piezoelectric element supporting substrate 32 that support the piezoelectric elements 31. Electrode pads (piezoelectric pads) 34 are connected to the piezoelectric element drive ICs 33, respectively, and the drive waveform generated by the piezoelectric element drive IC 33 is applied to the respective piezoelectric element 31 via the electrode pad 34 (see FIG. 6A).

Furthermore, the common ink flow channel 27 of the rigid plate 28 is connected to the ink tank 71 (see FIG. 2), in which the ink is filled, via an ink introduction pipe 30. An upper open end of the ink introduction pipe 30 is connected to the common ink flow channel 27 and a lower open end of the ink introduction pipe 30 is connected to the ink tank 71.

Figure 6A:
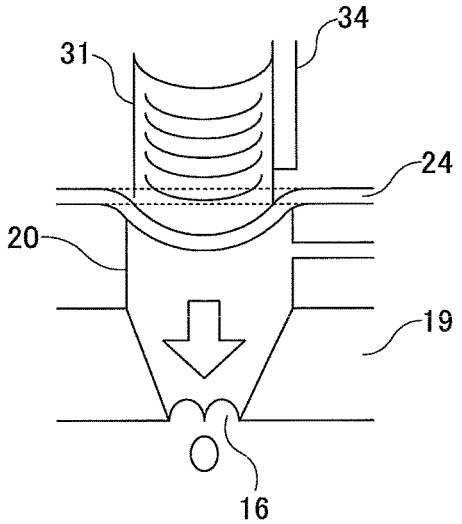
Figure 6B:
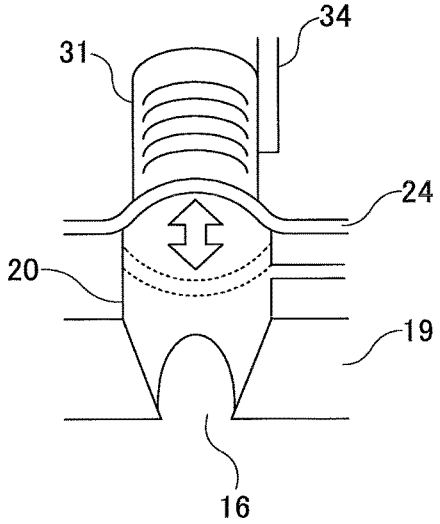

FIG. 6A and FIG. 6B are views schematically illustrating generation of remaining oscillation at the printing nozzle 16. Specifically, FIG. 6A illustrates change of pressure generated in the individual pressure generation chamber 20 when discharging ink, and FIG. 6B illustrates change of pressure generated in the individual pressure generation chamber 20 after the ink is discharged.

Figure 10:
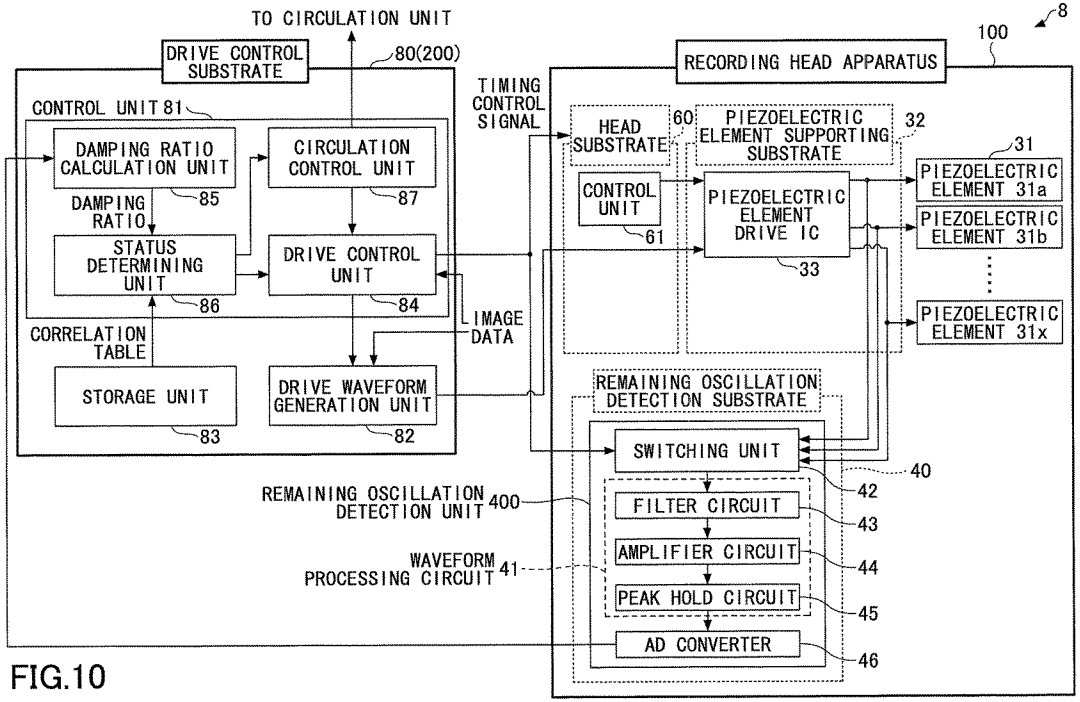
FIG. 10 is a block diagram illustrating a structure of components regarding driving and controlling of the inkjet recording module of the embodiment.

When discharging the ink as illustrated in FIG. 6A, the piezoelectric element drive IC 33 is switched ON/OFF in accordance with a timing control signal, based on image data, transmitted from the control unit 81 (a drive control unit 84) mounted on the drive control substrate 80, and a drive waveform generated at the drive waveform generation unit 82 is applied to the electrode pad 34 (see FIG. 2 and FIG. 10). When the pressure in the individual pressure generation chamber 20 is changed by stretching force of the piezoelectric element 31 based on the drive waveform via the oscillation plate 24, pressure in a printing nozzle 16 direction is generated to discharge the ink.

Specifically, in a discharging operation, first, by applying a falling drive waveform (see FIG. 7), the oscillation plate 24 contracts and the individual pressure generation chamber 20 expands to draw (up) meniscus, which is a curved surface of the liquid (ink) near the printing nozzle 16. Then, after applying a rising drive waveform, the oscillation plate 24 expands (moves downward in FIG. 6A) and the individual pressure generation chamber 20 contracts so that ink is pressurized and discharged from the printing nozzle 16. By the discharging operation of the ink, the position of the meniscus, which is a liquid surface, moves, in other words, the meniscus oscillates and the oscillation plate 24 oscillates for a predetermined period.

In this embodiment, the electrode pad 34 is provided near the oscillation plate 24 and near the individual pressure generation chambers 20. Even after stopping applying of the drive waveform, the position of the meniscus in the printing nozzle 16 changes depending on viscosity of the ink, and in accordance with this change, the magnitude of remaining oscillation in the individual pressure generation chamber 20 changes. Thus, according to the method of detecting the viscosity of the liquid of the embodiment, it can be said that the viscosity of the ink near the meniscus in the individual pressure generation chamber 20 can be detected.

As illustrated in FIG. 6B, after the ink is discharged, a remaining pressure wave that is generated in the individual pressure generation chamber 20 is transmitted to the piezoelectric element 31 via the oscillation plate 24, and a remaining oscillation voltage is applied (induced) to the electrode pad 34. By detecting the change of the applied (induced) remaining oscillation voltage, discharging speed of the ink, a discharging amount or blocking of the printing nozzle 16 due to the change of the viscosity of the ink can be detected.

Figure 7:
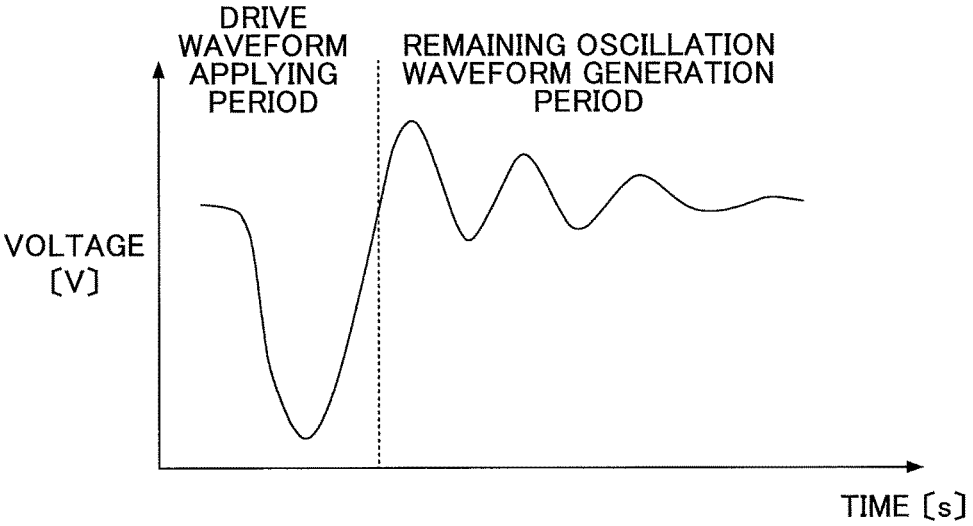
FIG. 7 is a graph schematically illustrating a drive waveform and a remaining oscillation waveform.

Here, a pressure status of the individual pressure generation chamber 20 and change of a voltage of the piezoelectric element 31 are described. FIG. 7 is a graph schematically illustrating a drive waveform and a remaining oscillation waveform.

A period of applying the drive waveform of FIG. 7 corresponds to the status of the individual pressure generation chamber 20 of FIG. 6A. As described above, before the status illustrated in FIG. 6A, the piezoelectric element 31 is compressed by the falling down operation of the drive waveform (see FIG. 7) and the oscillation plate 24 is pushed up to expand the individual pressure generation chamber 20. Here, when the individual pressure generation chamber 20 expands, the meniscus is pulled in and the ink introduction pipe 30 absorbs the ink from the in-head ink tank 71 because the pressure is lowered. Thereafter, as illustrated in FIG. 6A, as the piezoelectric element 31 is extended by the rising up operation of the voltage, the oscillation plate 24 is pushed down, and the individual pressure generation chamber 20 is contracted to discharge the ink. The remaining oscillation is generated after applying the drive waveform (after the ink is discharged).

A generation period of the remaining oscillation waveform of FIG. 7 corresponds to the pressure status of the individual pressure generation chamber 20 of FIG. 6B, and when the remaining pressure wave propagates to the piezoelectric element 31 via the oscillation plate 24, the remaining oscillation waveform becomes a damped oscillation waveform as illustrated in FIG. 7.

According to the embodiment, by using such a technique of detecting the remaining oscillation, as will be explained later with reference to FIG. 10, a remaining oscillation detection unit 400 configured with a circuit on a remaining oscillation detection substrate 40 detects the remaining oscillation via the electrode pad 34 and the piezoelectric element supporting substrate 32.

Figure 8:
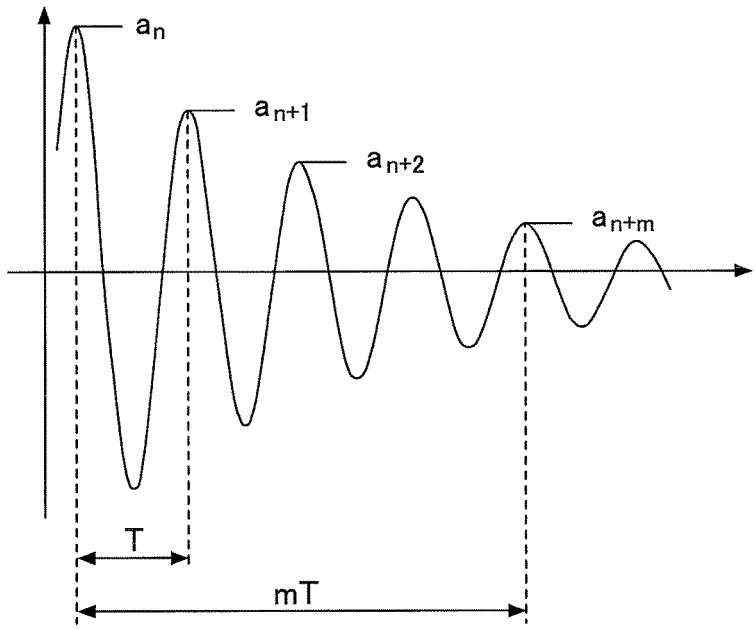
FIG. 8 is a view for explaining a method of calculating a damping ratio from a damped oscillation waveform of the embodiment.

FIG. 8 is a view for explaining a method of calculating a damping ratio from a damped oscillation waveform of the embodiment. The method of calculating a damping ratio ζ based on the damped oscillation waveform of FIG. 7 is described with reference to FIG. 8. Formula (1) indicates a theoretical formula of a damped oscillation.

[Formula 1]

$$x = e^{-\zeta\omega_0 t}\left(x_0\cos\omega_d t + \frac{\zeta\omega_0 x + v_0}{\omega_d}\sin\omega_d t\right) \tag{1}$$

In formula (1), "x" indicates a damped oscillation variation with respect to time, "$X_0$" indicates an initial variation, "ζ" indicates a damping ratio, "$\omega_0$" indicates a natural oscillation frequency, "$\omega_d$" indicates a natural oscillation frequency of a damped system, "$v_0$" indicates an initial variation, and "t" indicates time.

The natural oscillation frequency $\omega_d$ of the damped system is expressed by formula (2).

[Formula 2]

$$\omega_d = \sqrt{1-\zeta^2}\,\omega_0 \tag{2}$$

Logarithmic decrement δ is a parameter necessary for calculating the damping ratio ζ. Formula (3) indicates logarithmic decrement δ.

[Formula 3]

$$\delta = \frac{1}{m}\cdot \ell n\frac{a_n}{a_{n+m}} \tag{3}$$

In FIG. 8 and formula (3), "$a_n$" indicates an "n" th amplitude value, and "$a_{n+m}$" indicates an "n+m" th amplitude value. In FIG. 8, "T" indicates one period. The logarithmic decrement δ indicates an average value for one period by taking the logarithm of a ratio of amplitude variation and then dividing it by "m". Here, "n" and "m" are natural numbers, respectively.

As illustrated in formula (4), the damping ratio ζ is calculated by dividing the logarithmic decrement δ by 2π.

[Formula 4]

$$\zeta = \frac{\delta}{2\pi} \tag{4}$$

This means that the damping ratio ζ has information obtained by averaging damping factors of amplitude values of a plurality of periods for one period.

As described above, in order to calculate the damping ratio ζ, it is necessary to obtain the logarithmic decrement δ, and in order to obtain the logarithmic decrement δ, it is only necessary to obtain the amplitude values of the remaining oscillation waveform.

Figure 9:
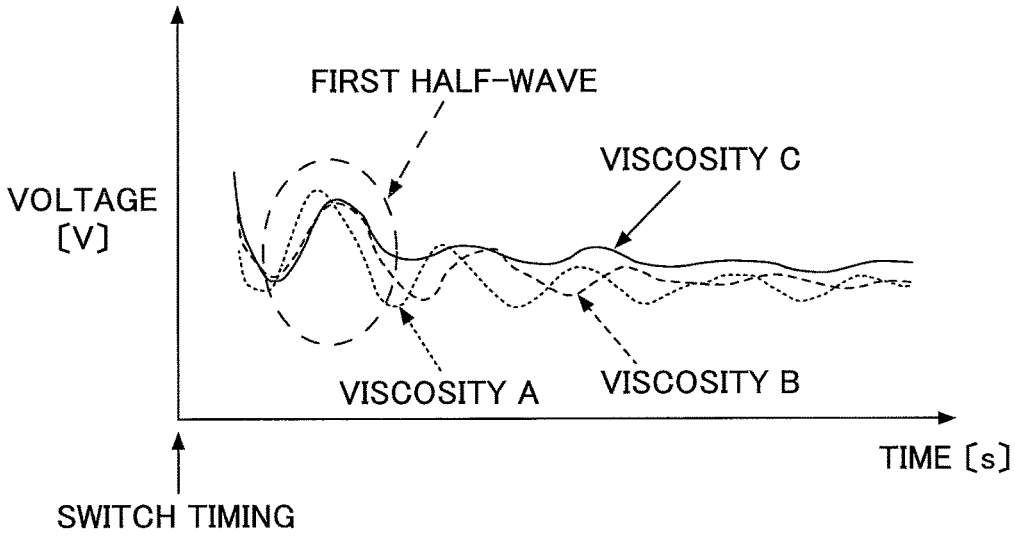
FIG. 9 is a graph illustrating a measured remaining oscillation waveform when ink viscosities are varied.

FIG. 9 is a graph illustrating a measured remaining oscillation waveform when ink viscosities are varied. Specifically, transitions of measured remaining oscillation waveforms of three kinds of ink viscosities are illustrated. Here, a switch timing at which the detected waveform is switched from the drive waveform to the remaining oscillation waveform by a switching unit 42 illustrated in FIG. 10 is indicated at a zero point in the time axis.

The relationships between the viscosities are; when it is assumed that the viscosity A=1, the viscosity B=1.7 and the viscosity C=3. From FIG. 9, it can be estimated that the smaller the viscosity of the ink (liquid) is the larger the amplitude of the damped oscillation becomes. Further, it can be understood from FIG. 9 that noises are superimposed on the measured waveforms, variation is large for the first half-wave, and there is no correlation between the degrees of ink viscosity and amplitude values for the first half-wave.

Figure 22:
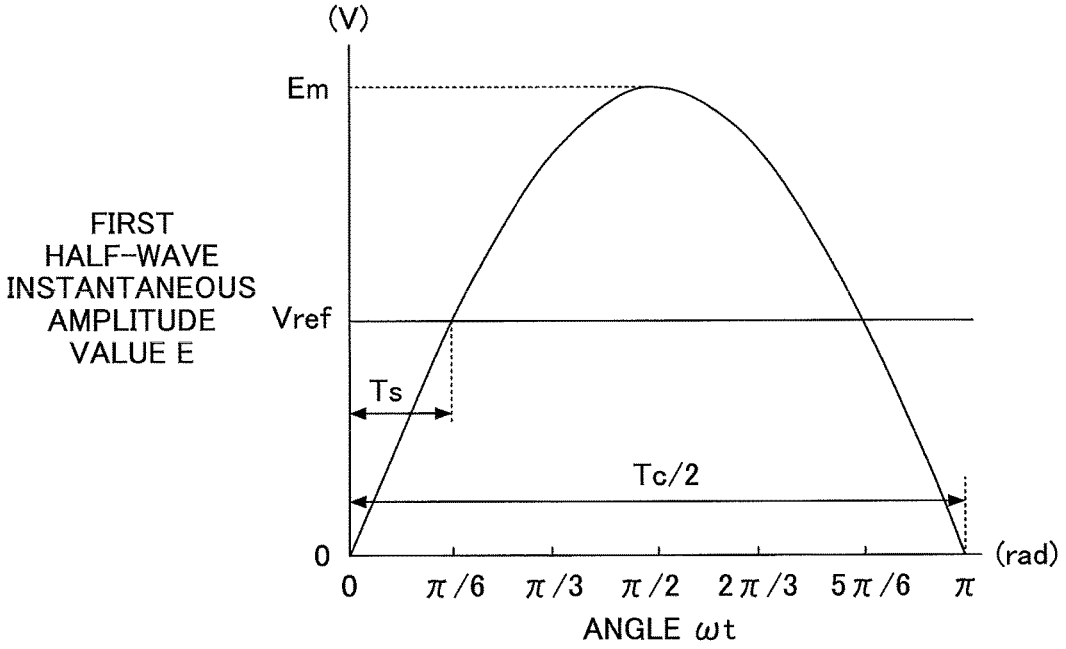
FIG. 22 is a graph illustrating a correlation relationship between an angle of remaining oscillation and an instantaneous amplitude value of a first half-wave in a conventional example.

According to the conventional example (see FIG. 22), change of the viscosity of the ink is detected using the amplitude value of the first half-wave. However, as the amplitude values of the first half-waves of the viscosity B and the viscosity C of FIG. 9 are almost the same values, it is impossible to discriminate between the viscosity B and the viscosity C.

In order to solve the above described problem, according to the embodiment, as a unit for detecting the liquid viscosity, a band-pass filter that cuts high frequency/low frequency noise components is adopted, and a method of detecting the viscosity of the ink using a damping ratio by which the variation of the first half-wave can be suppressed is adopted. The method of controlling is explained in detail later with reference to FIG. 12.

FIG. 10 is a block diagram illustrating a structure of components regarding driving and controlling of the inkjet recording module 8 of the embodiment. As described above with reference to FIG. 2, the inkjet recording module 8, which is the droplet discharging apparatus, includes the drive control substrate 80 and the recording head apparatus 100.

The drive control substrate 80 mainly includes the control unit 81, the drive waveform generation unit 82 and a storage unit 83. The control unit 81 includes the drive control unit 84, a damping ratio calculation unit 85, a status determining unit 86 and a circulation control unit 87.

The drive control unit 84 of the control unit 81 generates a timing control signal and drive waveform data based on image data. The drive waveform generation unit 82 DA converts the generated drive waveform data, amplifies voltage, and amplifies current. Here, the timing control signal generated at the drive control unit 84 is a signal for selecting the drive pulse (waveform) generated at the drive waveform generation unit 82.

The storage unit 83 previously stores a correlation table (data) of the damping ratio and viscosity of ink (concentration of ink).

The recording head apparatus 100 includes the plurality of piezoelectric elements 31 (indicated as 31*a* to 31*x* in FIG. 10), a head substrate 60 that drives and controls the piezoelectric elements 31*a* to 31*x*, the piezoelectric element supporting substrate 32 and the remaining oscillation detection substrate 40. As described above, the piezoelectric element supporting substrate 32 and the piezoelectric elements 31*a* to 31*x* are components of the recording head 15 (see FIG. 2 and FIG. 3).

A head side control unit 61 is formed on the head substrate 60, and the piezoelectric element drive IC(s) 33 is formed on the piezoelectric element supporting substrate 32. The remaining oscillation detection unit 400 is formed on the remaining oscillation detection substrate 40. The remaining oscillation detection unit 400 includes the switching unit 42, a waveform processing circuit 41 and an AD converter 46. The waveform processing circuit 41 includes a filter circuit 43, an amplifier circuit 44 and a peak hold circuit 45. The waveform processing circuit 41 has a waveform processing function and is capable of detecting amplitude values of a plurality of periods of the remaining oscillation waveform. This will be explained in detail with reference to FIG. 11.

At the drive control substrate 80, the digital signal such as the timing control signal or the like generated by the drive control unit 84 is transmitted to the control unit 61 by a serial communication, and de-serialized by the control unit 61 on the head substrate 60 to be input in the piezoelectric element drive IC 33.

The drive waveform generated by the drive waveform generation unit 82 of the drive control substrate 80 is input to the respective piezoelectric element 31 when the piezoelectric element drive IC 33 is ON, that is switched ON/OFF in accordance with the status of the timing control signal (H/L or ON/OFF) generated at the drive control unit 84.

The drive control unit 84 also controls a timing at which the remaining oscillation voltage generated at the piezoelectric element 31 is detected by the remaining oscillation detection substrate 40 by sending a switching signal to the switching unit 42 that synchronizes the timing control signal sent to the piezoelectric element drive IC 33. Here, the remaining oscillation voltage is generated at the piezoelectric element 31 after the ink is discharged due to the drive waveform or by a faint drive waveform or an empty discharging waveform that is applied in a maintenance and recovery operation as will be explained later.

The amplitude value of the remaining oscillation held by the peak hold circuit 45 is converted to a digital value by the AD converter 46, and is fed-back to the damping ratio calculation unit 85 of the control unit 81.

In the control unit 81, the damping ratio calculation unit 85 calculates the damping ratio based on the amplitude values, the status determining unit 86 detects the change of the viscosity of the ink (degree of sedimentation) at each of the printing nozzles by comparing the calculated damping ratio and the damping ratio set in the correlation table stored in the storage unit 83. Then, the circulation control unit 87 sets and controls a circulation operation in accordance with the detected degree of sedimentation of the ink. The circulation control unit 87 properly sends information regarding a timing for a faint drive waveform or an empty discharging waveform that is applied during a maintenance and recovery operation to the drive control unit 84.

The control unit 81 may configured with a single circuit in which all of the functions are included, or alternatively, a plurality of control units corresponding to the above described functions, respectively, may be provided in the control unit 81. For example, the control unit 81 may include the damping ratio calculation unit 85 and the status determining unit 86 for each function. The damping ratio calculation unit 85 calculates a damping ratio based on the amplitude values of the plurality of periods, and the status determining unit 86 (viscosity calculation unit) calculates change of the viscosity of the ink in each of the printing nozzles by comparing the calculated damping ratio and damping ratio data, in other words, determines a status in each of the liquid chambers.

Figure 15:
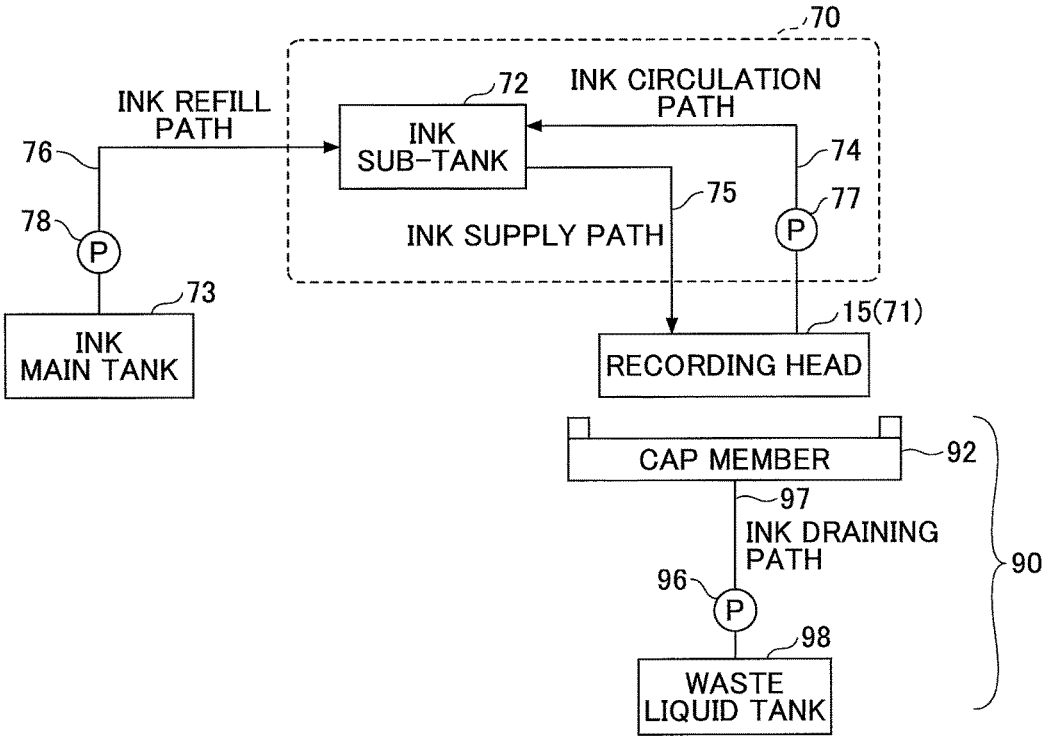
FIG. 15 is a view schematically illustrating a structure of a maintenance and recovery module.

The status determining unit 86 outputs the determined result of the status of each of the liquid chambers to the circulation control unit (control unit) 87. The circulation control unit 87 controls a circulation module (a circulation unit 70, an ink supplying unit (73, 78 and 76, a liquid supplying unit) and the maintenance and recovery mechanism 90), as illustrated in FIG. 15 to FIG. 17, based on the determined result of the status (degree of sedimentation of ink) of each of the liquid chambers.

Here, although the damping ratio calculation unit 85 of the control unit 81 that calculates the damping ratio is provided on the drive control substrate 80 in FIG. 10, this is not limited so. The damping ratio calculation unit 85 may be mounted on the remaining oscillation detection substrate 40 of the recording head apparatus 100, for example.

A part of or the entirety of the functions mounted on the remaining oscillation detection substrate 40 may be mounted on the drive control substrate 80 or on the head substrate 60.

Further, in the example of FIG. 10, a single set of the switching unit 42, the waveform processing circuit 41 and the AD converter 46 is used and the remaining oscillation voltages of the plurality of piezoelectric elements 31 are detected in order by switching the piezoelectric element 31 to be detected. Alternatively, a plurality of sets of the switching unit, the waveform processing circuit and the AD converter corresponding to all of the piezoelectric elements 31 may be used, and the viscosities of the inks of all of the printing nozzles may be detected at the same time.

Alternatively, all of the piezoelectric elements 31 may be divided into a plurality of groups, and a set of the switching unit, the waveform processing circuit and the AD converter may be used for each of the groups, and the remaining oscillation voltages of the piezoelectric elements 31 may be detected in order by switching the piezoelectric element 31 to be detected in each of the groups. With this configuration, the number of printing nozzles for which the viscosities of the inks can be detected at the same time is increased while the number of circuits can be reduced.

Figure 11:
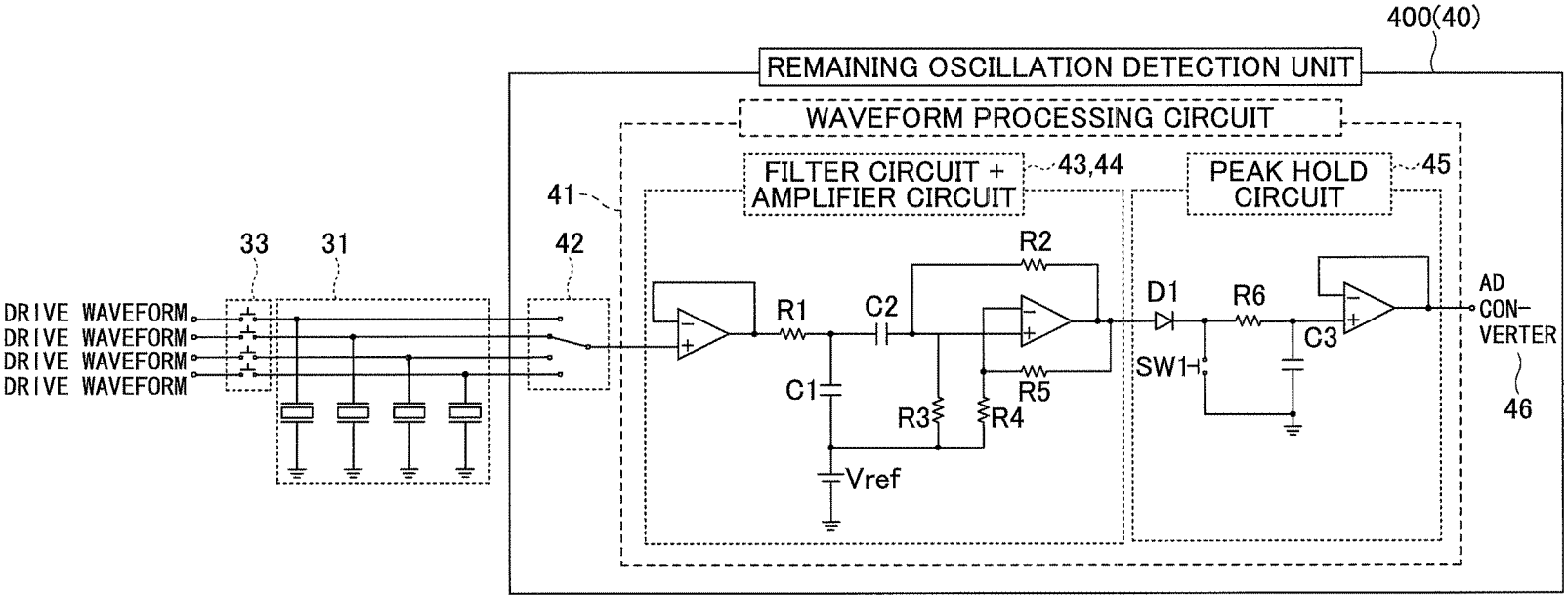
FIG. 11 is a diagram of a circuit formed on a remaining oscillation detection substrate of the embodiment.

FIG. 11 is a diagram illustrating a circuit formed on the remaining oscillation detection substrate 40 of the embodiment. By switching on each of the piezoelectric element drive ICs 33 in the circuit of FIG. 11, a timing for applying the drive waveform to the respective piezoelectric element 31 is controlled and the ink can be discharged.

Furthermore, the switching unit 42 is capable of connecting and disconnecting between one of the piezoelectric elements 31 and the waveform processing circuit 41. By switching the switching unit 42 to connect one of the piezoelectric elements 31, for which the amplitude values of the remaining oscillation waveform are to be detected, to the waveform processing circuit 41 at a timing at which the respective piezoelectric element drive IC 33 is switched off, the waveform processing circuit 41 can obtain the amplitude values of the remaining oscillation waveform.

In FIG. 11, the amplitude values of each of two or more of the piezoelectric elements 31 are detected by the single waveform processing circuit 41 using the switching unit 42. With this configuration, the number of components for the remaining oscillation detection unit can be reduced.

As illustrated in FIG. 10, the waveform processing circuit 41 includes the filter circuit 43, the amplifier circuit 44 and the peak hold circuit 45. FIG. 11 illustrates an example in which a filtering function and an amplifying function are configured together.

In the waveform processing circuit 41, by receiving the faint remaining oscillation waveform by a buffer portion with high impedance, influence of the remaining oscillation detection unit 400 to the remaining oscillation waveform is suppressed.

The filter circuit 43 and the amplifier circuit 44 are configured with a band-pass filter amplifier, generally called a Sallen-Key amplifier. The filter circuit has a predetermined pass bandwidth with a meniscus natural oscillation frequency that is determined by the characteristics of the recording head 15 as a center frequency.

Further, for example, the filter circuit 43 and the amplifier circuit 44 are configured such that bandwidth at which the gain becomes "−3 dB" becomes three times of the pass bandwidth. With this pass bandwidth, the variation of the natural oscillation frequency due to the process variation of the head can be absorbed and high frequency and low frequency noises can be efficiently removed. Thus, efficient removing of the noise components and extracting of the signal components can be performed.

The amplification factor of the amplifier circuit 44 is set such that the waveform is amplified within a value capable of being input to the AD converter 46.

The peak hold circuit 45 detects two or more amplitude values, which are peak values, of the remaining oscillation (plurality of frequencies), and retains the values until being reset. Values (reset values) of the resistor R6 and the capacitor C3 of the peak hold circuit 45 are controlled such that the discharging period becomes less than or equal to ½ of the remaining oscillation period.

The peak hold circuit 45 may be reset by inputting a reset signal from the control unit 61 at a timing when the rising of the damped oscillation waveform crosses a predetermined voltage Vref, for example. This means that the peak hold circuit 45 may include a reset circuit having a reset function, and a reset timing can be arbitrarily set by being controlled by the control unit 61. By adjusting the reset timing as such, the releasing timing for retaining the amplitude values can be adjusted.

Alternatively, the peak hold circuit 45 may include a comparing unit (not illustrated in the drawings) having a comparing function in addition to the reset circuit. In such a case, the reset timing of the reset circuit is controlled by the comparing unit that is operated by the remaining oscillation waveform. Specifically, the comparing unit, not illustrated in the drawings, may detect a timing at which the rising of the remaining oscillation waveform crosses a predetermined voltage Vref, and may input it a switch SW1. According to this control, reset can be performed by an analog system only.

Here, the timing is not limited to the above described example, and as long as the amplitude values of the damped oscillation waveform can be detected, any timing can be adapted. Further, the structure of the peak hold circuit 45 is not limited to that of FIG. 11, and another structure can be adopted as long as the circuit structure has a function to obtain the amplitude values.

The filter circuit 43 and the amplifier circuit 44 are not limited to the Sallen-Key type as long as a combination of a filter having a high-pass filtering characteristic and a low-pass filtering characteristic and a noninverting amplifier or an inverting amplifier is used.

Here, it is desirable that passive element constant of each of the resistors R1 to R5 and the capacitors C1 to C3 is variably controlled by the control unit 81 (see FIG. 10) in accordance with the difference in the natural oscillation frequency due to the characteristics of the inkjet recording head 15. With this control, the filter function can be arbitrarily controlled.

For example, there is a variation in natural oscillation frequencies for the recording heads 15 due to process variations. Thus, the variation in natural oscillation frequencies may be previously obtained in a testing step. Then, the passive element constants of the resistors (R1 to R5) and the capacitors (C1 and C2) are controlled such that the natural oscillation frequency of each of the recording heads 15 becomes the center frequency of the filter circuit 43.

Alternatively, for the case when it is difficult to control the constants of the filter circuit 43 in accordance with each of the recording heads 15, variation in natural oscillation frequencies may be obtained for the recording heads 15 of an arbitrarily selected lot in a testing step. Then, the control unit 81 controls the filter circuit 43 such that the pass bandwidth becomes broader for the recording heads 15 of the respective lot if the variation is large, while the control unit 81 controls the filter circuit 43 such that the pass bandwidth becomes narrower for the recording heads 15 of the respective lot if the variation is small.

As such, in the waveform processing circuit 41, the filter circuit 43 sets a pass bandwidth to remove noise, the amplifier circuit 44 amplifies the passing voltage waveform, and the peak hold circuit 45 holds the peak values (amplitude values) of the amplified waveform of the plurality of periods for a predetermined period. A method of calculating the damping ratio using the amplitude values obtained by the circuit is described with reference to FIG. 12.

Figure 12:
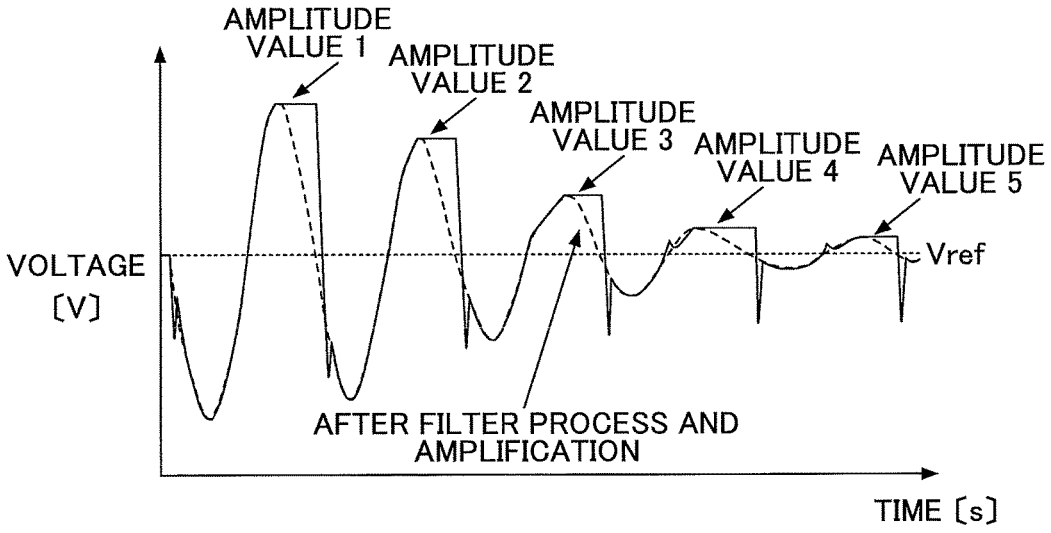
FIG. 12 is a graph illustrating a waveform of detected amplitude values when the circuit of FIG. 11 of the embodiment is used.

FIG. 12 is a graph illustrating a waveform of detected amplitude values when the circuit of FIG. 11 of the embodiment is used. In FIG. 12, dashed lines indicate experimental waveforms of the remaining oscillation after performing the filtering process and the amplifying process by the circuit of the embodiment, and the solid lines indicate experimental waveforms of the amplitude values of the half-waves held by the peak hold circuit 45.

The damping ratio ζ can be calculated from at least two amplitude values using the formula (3) and the formula (4), and if the damping ratio ζ is calculated from three of more amplitude values, the accuracy is increased.

For example, FIG. 12 illustrates a waveform in which amplitude values of upper side of the amplitudes (upper amplitude values) of first to fifth half-waves are detected, and the damping ratio ζ can be calculated by averaging the amplitude values of 4 periods. Alternatively, the damping ratio ζ may be calculated by detecting amplitude values of lower side of the amplitudes (lower amplitude values), and in such a case, an inversion amplifier circuit may be used as the amplifier circuit 44 in the circuit of FIG. 11. As such, by detecting only either of the upper amplitude values or the lower amplitude values, the size of the circuit can be reduced and cost can be reduced as well.

According to the embodiment, as illustrated in FIG. 8 and FIG. 12, the damping ratio is calculated by detecting a plurality of amplitude values (peak values) that are not influenced by time and averaging them. Thus, compared with the conventional example of FIG. 22 in which the period Ts to the reference voltage Vref and the period Tc are compared, even when variation occurs due to the ON resistor/ON time of the switching unit 42, the change of the viscosity of the ink can be accurately detected by reducing the influence of the switching variation.

Here, as the damping ratio ζ can be calculated by using the two or more of the detected amplitude values, it is desirable that the amplitude values to be used can be arbitrarily selected by the damping ratio calculation unit 85 of the control unit 81. By properly selecting the amplitude values to be used, the damping ratio can be calculated more accurately.

For example, as explained above regarding the conventional example, the amplitude value of the first half-wave tends to vary by the influence of the variation of the switching unit 42. However, the damping ratio calculation unit 85 may obtain the damping factor as the damping ratio ζ by averaging the damping factors of the amplitude values of the second or latter half-waves, excluding the amplitude value of the first half-wave, for one period. Specifically, after being switched by the switching unit 42, the waveform processing circuit 41 calculates the damping ratio ζ based on the amplitude values of the plurality of periods from which the amplitude value of the first half-wave is excluded because the amplitude value of the first half-wave is easily influenced by the variation of the switching unit 42. In this calculation, by excluding the first half-wave whose variation is large, the influence of the variation of the ON resistor/ON time of the switching unit 42 can be further suppressed, calculation accuracy of the damping ratio is increased, and the change of the viscosity of the ink can be accurately detected.

Alternatively, the damping ratio ζ may be calculated based on the amplitude values of the plurality of periods from which the smallest amplitude value for which a detection error becomes max (the amplitude value with a smallest absolute value)(for the example illustrated in FIG. 12, the fifth half-wave) is excluded. In this configuration, by excluding the amplitude whose signal component is relatively small, calculation accuracy of the damping ratio can be increased. Alternatively, the damping ratio ζ may be calculated by excluding both of the amplitude value of the first half-wave and the smallest amplitude value. Selecting patterns are not limited so.

As illustrated in FIG. 11 and FIG. 12, in this embodiment, amplitude values of the remaining oscillation waveform can be detected, the damping ratio of the remaining oscillation waveform can be calculated and faint change of the viscosity of the ink can be accurately detected by a simple circuit structure using only a general operational amplifier, passive elements and a switch.

Figure 13:
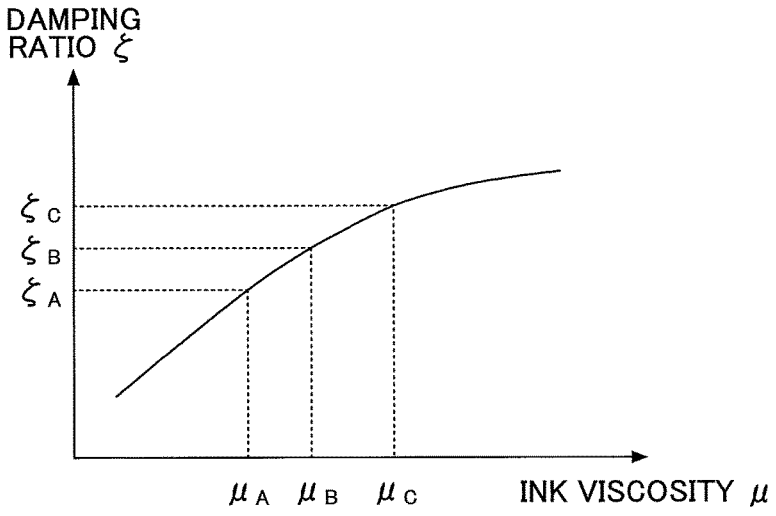
FIG. 13 is a view illustrating correlation between a damping ratio $\zeta$ calculated using the detected results of FIG. 12 and viscosity of ink.

FIG. 13 is a view illustrating correlation between the damping ratio ζ calculated using the detected results of FIG. 12 and the viscosity μ of the ink. From FIG. 13, it can be understood that as the viscosity μ of the ink increases, the damping ratio ζ also increases.

Generally, a status when the damping ratio ζ=1 is called critical damping, and at this status, the remaining oscillation illustrated in FIG. 7 does not exist at all. At this time, the printing nozzle is completely blocked. However, it can be considered that blocking of the printing nozzle at which ink is not discharged due to increasing of the viscosity of the ink actually occurs before the printing nozzle is completely blocked and when the damping ratio ζ is less than 1 but at a predetermined value.

Although the damping ratio and the blocking of the printing nozzle largely depend on the nozzle diameter, the nozzle shape, components of the ink or the like, according to experiments, it was confirmed that the blocking of the ink tends to occur when the damping ratio ζ becomes greater than or equal to 0.2. When the printing nozzle is blocked, there is a possibility that a defective pixel exists in printing because the ink is not discharged from the blocked printing nozzle.

Thus, a maintenance and recovery operation (circulation/draining and refilling ink) for the blocking of the printing nozzle and sedimentation of the ink may be performed by configuring to detect that the discharging port is blocked when the detected damping ratio ζ is greater than or equal to a predetermined value.

Figure 14:
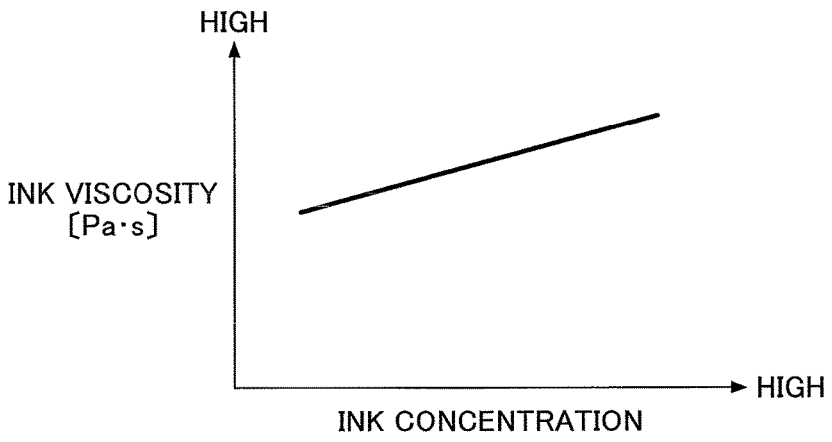
FIG. 14 is a view illustrating a relationship between viscosity and concentration of ink.

FIG. 14 is a view illustrating a relationship between the viscosity and the concentration of the ink. The physical property values of the ink are constituted by viscosity, density, surface tension and volume elasticity. Thus, in the sedimentary ink, if the colorant, the magnetic material or the like in the ink sediments, the viscosity which is one of the ink physical property values changes. With reference to FIG. 14, the relationship between the sedimentation of the ink component (component in liquid) and the viscosity of the ink is described.

In FIG. 14, the horizontal axis indicates concentration of the ink, and the vertical axis indicates viscosity of the ink. As illustrated in FIG. 14, the viscosity of the ink tends to increase in proportion to the concentration. Thus, if the pigment or the magnetic material, which is the ink component, sediments, the ink mainly includes solvent as the component, and the ink concentration at an upper portion of an ink reservoir is lowered.

As described above, the viscosity of the ink is lowered in accordance with the sedimentation of the ink component, by estimating the lowering of the viscosity from the damping ratio, the sedimentation status of the sedimentary ink can be detected from the ink concentration.

FIG. 15 is a view schematically illustrating a structure of a maintenance and recovery module regarding the recording head 15. In this embodiment, the maintenance and recovery mechanism 90, the circulation unit 70 and the ink supplying unit (73, 78, 76) illustrated in FIG. 15 are referred to as the maintenance and recovery module. FIG. 16 is a view schematically illustrating the inkjet recording module 8 and the maintenance and recovery mechanism 90 of the embodiment. FIG. 17 is a view for explaining a maintenance and recovery operation of the inkjet recording module 8 and the maintenance and recovery mechanism 90 of FIG. 16.

An ink sub-tank 72 is an ink reservoir configured with an aluminum pouch or the like. The ink is supplied from an ink main tank 73 by a refill pump 78 or the like via an ink refill path 76. The ink sub-tank 72 and the in-head ink tank 71 (in-head reservoir) in the recording head 15 (see FIG. 2) is connected via an ink supply path 75 and an ink circulation path 74 configured with a tube or the like (two liquid transporting pipes). The ink supply path 75 is a tube that supplies the ink in the ink sub-tank 72 to the in-head ink tank 71 in the recording head 15 using a water head difference. The ink in the in-head ink tank 71 of the recording head 15 is circulated to the ink sub-tank 72 by a circulation pump 77 via the ink circulation path 74.

Figure 16:
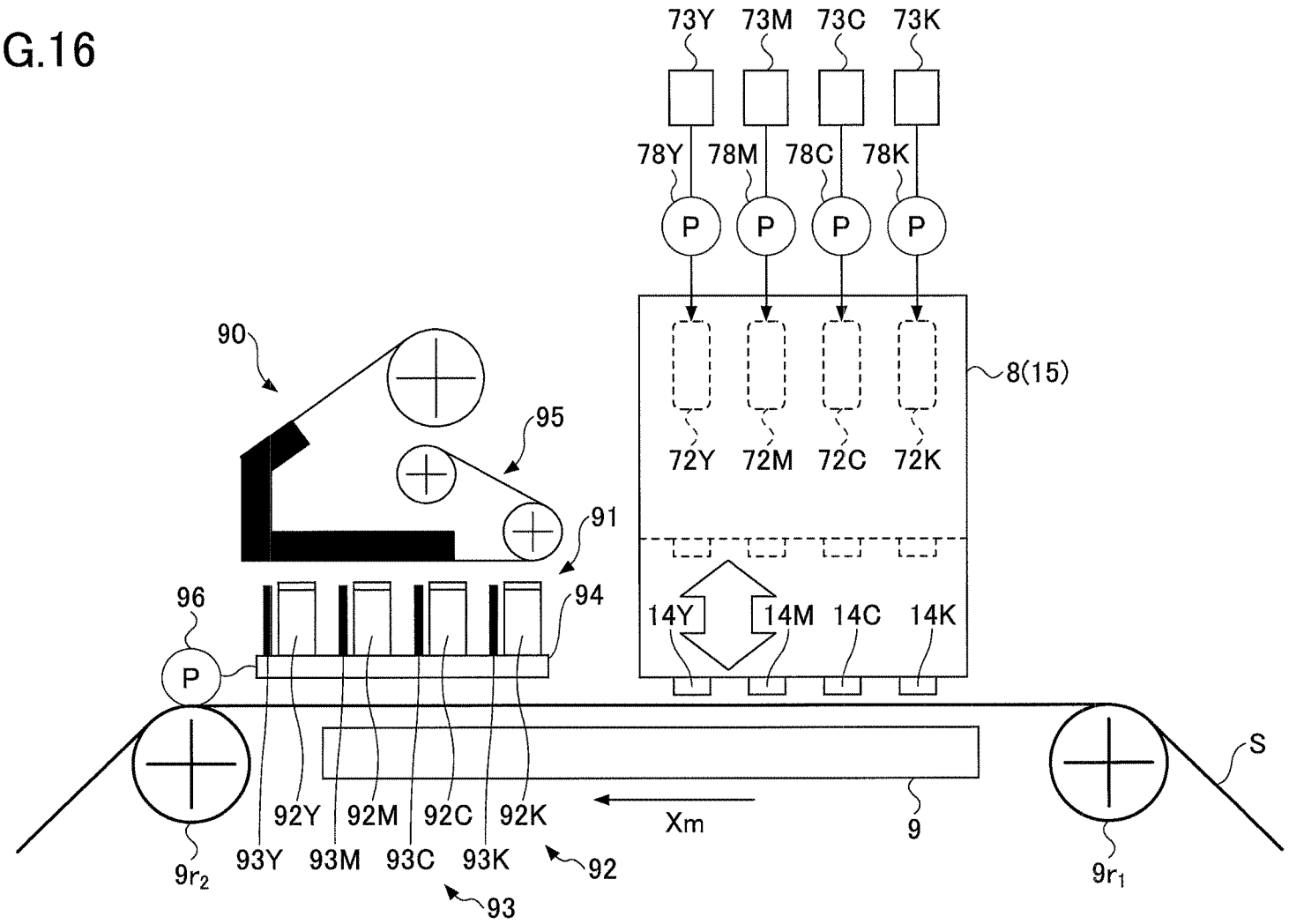
FIG. 16 is a view schematically illustrating the inkjet recording module and a maintenance and recovery mechanism of the embodiment.

As illustrated in FIG. 16, the inkjet recording module 8 is placed to face the platen 9 and (drive) rollers **9*r*1 and 9*r*2, which are a conveying unit. The recording medium S is conveyed in a direction indicated by the arrow Xm. The maintenance and recovery mechanism 90 is provided downstream (left side in FIG. 16) of the inkjet recording module 8 in the conveying direction Xm of the recording medium S. The maintenance and recovery mechanism 90 performs the maintenance and recovery operation (dissolving operation of the sedimentation of the ink) of the recording head 15 of the line head inkjet recording module 8**.

As the maintenance and recovery operation, first, in the recording head 15, a process of covering the nozzle surface 17 by a cap member 92 (hereinafter, referred to as a "capping operation") is performed for preventing the thickening of a meniscus portion after printing.

Even by the capping operation, drying of the nozzle can be prevented for a predetermined period to a certain degree (maintenance operation). Further, depending of a kind of ink, an absorbent (not illustrated in the drawings) may be provided in the cap member 92 and the nozzle surface 17 may be capped. With this configuration, the liquid can be permeated in the absorbent and the moisture status can be retained for a long period.

As will be explained later with reference to FIG. 20 and FIG. 21 in detail, according to the embodiment, a certain maintenance and recovery operation is performed based on the damping ratio calculated from the remaining oscillation. Examples of the maintenance and recovery operation are illustrated in Table 1.

TABLE 1

| No. | DAMPING RATIO | DEGREE OF SEDIMENTATION OF INK (INK VISCOSITY) | COMPARISON WITH THRESHOLD | MAINTENANCE AND RECOVERY OPERATION |
|---|---|---|---|---|
| 1 | $\xi_A$ (SMALL) | $\mu_A$ | $\mu_A < \mu_{REF}$ | ONLY CAPPING |
| 2 | $\xi_B$ (LARGE) | $\mu_B$ | $\mu_B \geq \mu_{REF}$ | CAPPING + INK CIRCULATION OPERATION + INK DRAINING AND REFILLING OPERATION |

From Table 1, when the degree of sedimentation of ink is smaller than a threshold $\mu_{REF}$ and the viscosity is not high, only the capping operation (maintenance operation) is performed and the recovery operation is not performed. When the degree of sedimentation of ink is greater than or equal to the threshold $\mu_{REF}$, in addition to the capping operation, ink circulation operation and an ink draining and refilling operation are performed.

Figure 18:
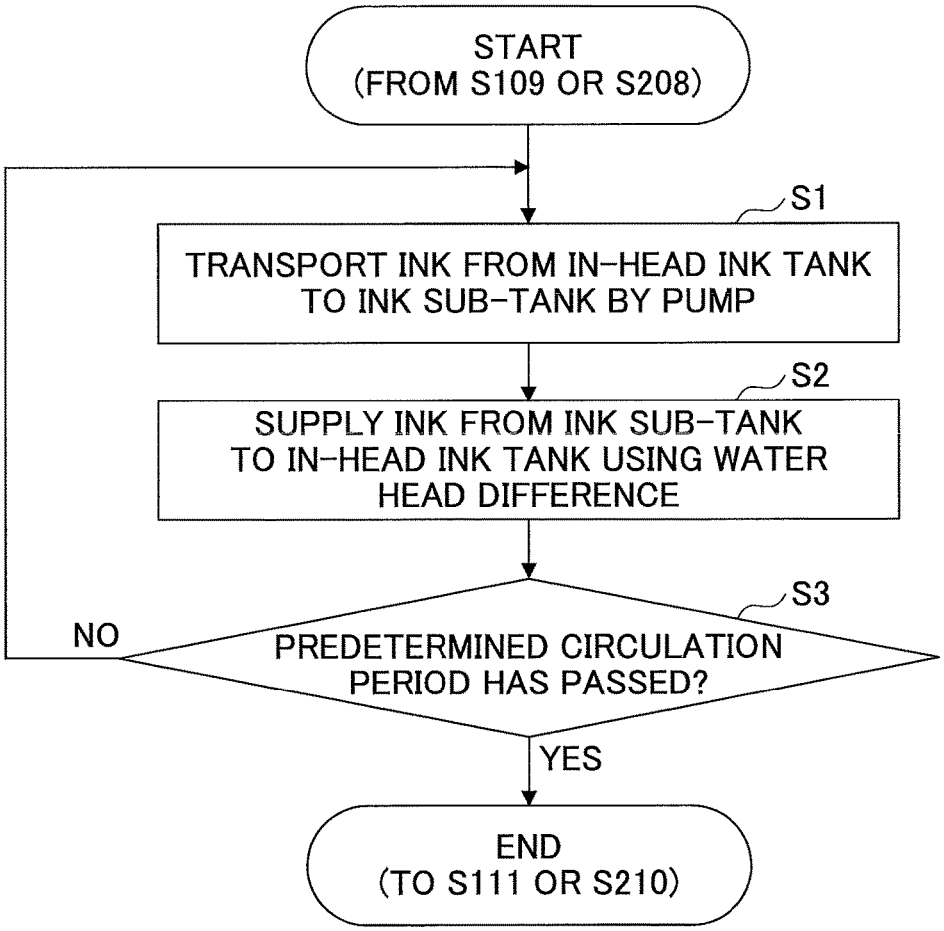
FIG. 18 is a flowchart illustrating an ink circulation operation in detail.

FIG. 18 is a flowchart illustrating the ink circulation operation after the capping operation, as the recovery operation (ink sedimentation dissolving operation).

First, in S1, the ink is transported from the in-head ink tank 71 to the ink sub-tank 72 by the pump 77 via the ink circulation path 74. Then, the ink is supplied from the ink sub-tank 72 to the in-head ink tank 71 via the ink supply path 75 using a water head difference (S2). As such, the ink is circulated between the in-head ink tank 71 and the ink sub-tank 72. Such a circulation operation is continuously performed until a predetermined period has passed (S3).

Figure 17:
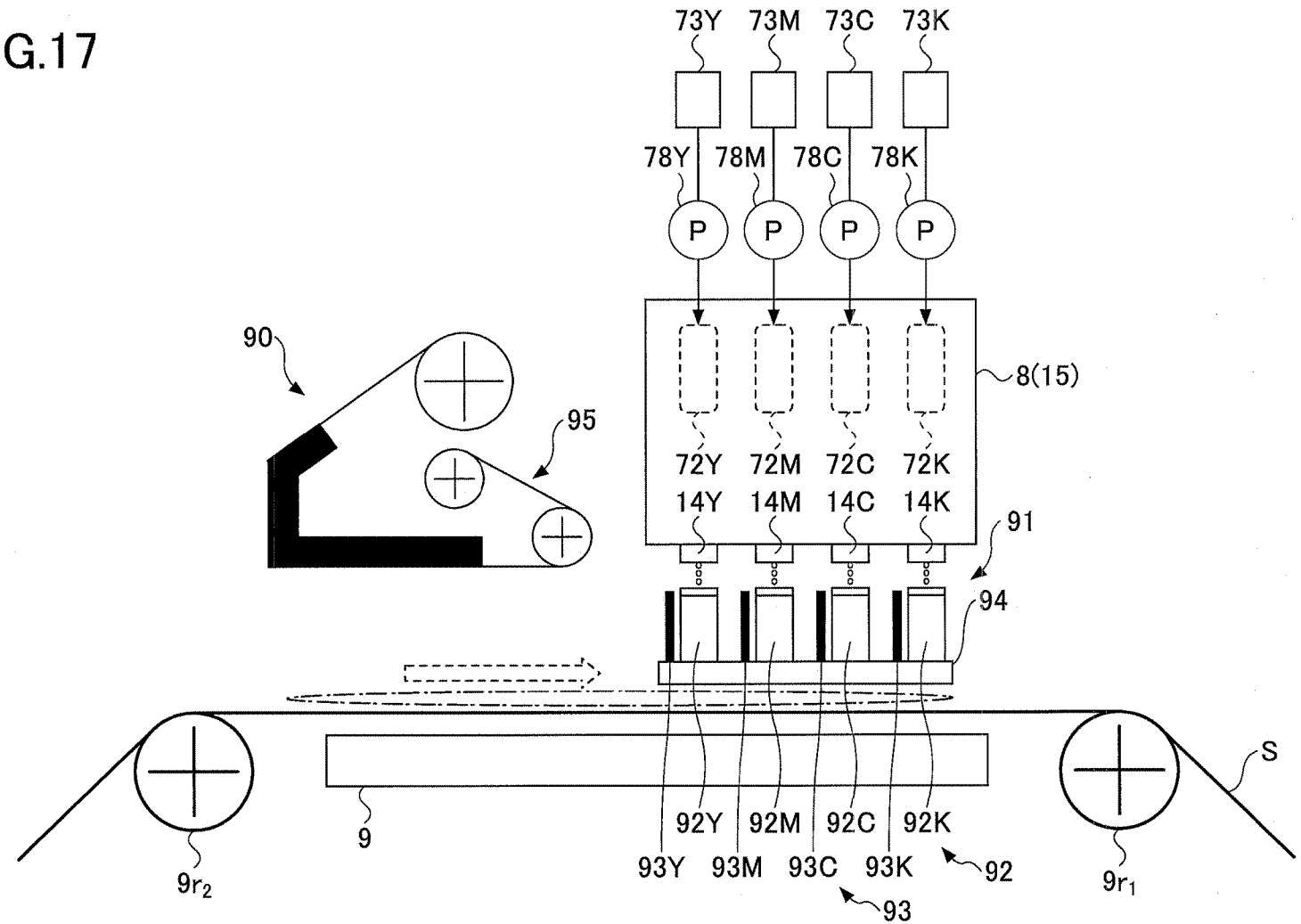
FIG. 17 a view for explaining a maintenance and recovery operation of the inkjet recording module and the maintenance and recovery mechanism of FIG. 16.

With reference to FIG. 16 and FIG. 17, the recording head 15 of the inkjet recording module 8 is configured to be movable in a vertical direction. The inkjet recording module 8 is capable of moving between a recording position (a printing position) near the platen 9 at which the liquid (ink) is discharged as illustrated in FIG. 16, and a spaced position spaced from the platen 9 as illustrated in FIG. 17. The spaced position is a maintenance position at which the maintenance and recovery mechanism 90 performs the maintenance operation for the inkjet recording module 8, and is also a standby position at which the inkjet recording module 8 is held until a next printing operation.

Here, in order to be moved in the vertical direction, for example, the inkjet recording module 8 may include a moving unit provided inside. For example, although the moving operation is illustrated by an arrow in FIG. 16, as the moving unit, a moving mechanism of a combination of a rail and a roller may be used, or the inkjet recording module 8 may be moved by an arm or the like.

The recording medium S is conveyed on the platen 9 (supporting member) by the drive rollers **9*r*1 and 9*r*2 rotated by the motor in the transfer unit. Although the recording medium S is illustrated to be spaced from the platen 9 in FIG. 16 and FIG. 17 for explanation purposes, it is desirable that the recording medium S contacts the platen 9. Here, the platen 9 may include a suction unit or an electrostatic adsorption unit that adsorbs the recording medium S while being conveyed. Further, a transfer belt may be provided to be hung around the platen 9 and the drive rollers 9*r*1 and 9*r*2** and rotated around, and the recording medium S may be conveyed by the transfer belt.

As illustrated in FIG. 16, the maintenance and recovery mechanism 90 includes the engaging unit 91 and a cleaning unit 95. The engaging unit 91 includes heads corresponding to the head arrays 14K, 14C, 14M and 14Y of the inkjet recording module 8, respectively. When performing the maintenance operation, the engaging unit 91 is moved to face the head arrays 14K, 14C, 14M and 14Y of the inkjet recording module 8, that are at the spaced position (FIG. 17) and the heads of the engaging unit 91 selectively engage the head arrays 14K, 14C, 14M and 14Y, respectively.

The engaging unit 91 includes cap members 92 (92K, 92C, 92M and 92Y), wipers 93 (93K, 93C, 93M and 93Y) and the supporting member 94 that fixes the cap members 92 and the wipers 93.

The members 92K, 92C, 92M and 92Y engage the recording heads 15 of the head arrays 14K, 14C, 14M and 14Y at the spaced position to seal the nozzles of the recording heads 15 (see FIG. 3).

The cleaning unit 95 cleans the cap members 92, the wipers 93 or the like, after the reciprocating motion of the engaging unit 91 in the maintenance operation and after the engaging unit 91 moves back to the home position. The cleaning of the engaging unit 91 by the cleaning unit 95 may be periodically performed after images are formed for a predetermined number of times or the like.

As described above with reference to FIG. 15, the maintenance and recovery mechanism 90 further includes the draining pump 96, the ink draining path 97 and the waste liquid tank 98. The draining pump 96 has a function of a suction unit for suctioning the ink in the recording heads 15 when the cap members 92 engage the recording heads 15 at the spaced position, respectively, to draining the ink outside of the recording heads 15, as a liquid draining mechanism. The ink draining path 97 is connected to a bottom portion of the cap members 92 and the draining pump 96 is provided in the ink draining path 97 for draining the ink outside of the recording head 15. The waste liquid tank 98 reserves the liquid (ink) that is drained from the draining path 97.

The maintenance and recovery mechanism 90 includes a moving unit that moves the engaging unit 91 (see a dashed line in FIG. 17). The moving unit of the engaging unit 91 includes a reciprocating unit that horizontally moves the engaging unit 91 to face the recording head 15, and a vertical moving unit that supports the reciprocating unit and moves the cap members 92 with the engaging unit 91 in the vertical direction.

When performing the maintenance and recovery operation (ink sedimentation dissolving operation) by using such a structure, as illustrated in FIG. 17, the inkjet recording module 8 is moved upward to take the spaced position and the engaging unit 91 of the maintenance and recovery mechanism 90 horizontally moves right below each of the recording heads 15 at the paced position and then moves upward to engage the recording heads 15.

As described above, after printing is finished, first, the maintenance and recovery mechanism 90 performs the capping operation in order to prevent thickening of the meniscus portion.

As described above, by performing the circulation operation of S1 to S3, sedimentation of the ink pigment in the head ink tank 71 can be dissolved. However, there is a case that it is difficult to circulate the ink remaining in the individual pressure generation chamber 20 (individual liquid chamber) depending on the structure of the recording head 15. Thus, an operation of draining the ink remaining in the individual pressure generation chamber 20 is performed.

Figure 19:
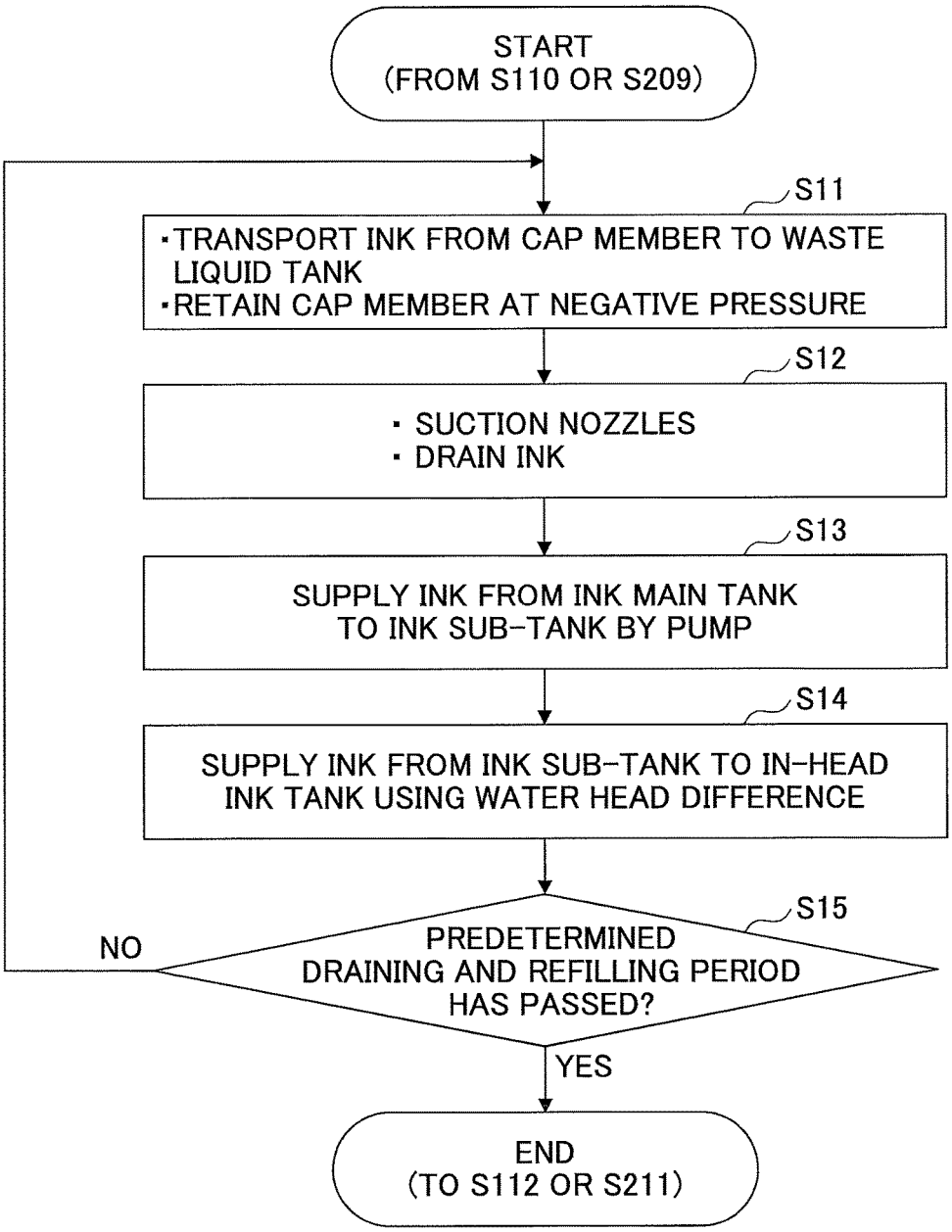
FIG. 19 is a flowchart illustrating an ink draining and refilling operation in detail.

FIG. 19 is a flowchart illustrating the ink draining and refilling operation. With reference to FIG. 15 and FIG. 17 as well, first, the ink in each of the cap members 92 is transported to the waste liquid tank 98 by the draining pump 96 so that the each of the cap members 92 is retained at a negative pressure in the maintenance and recovery mechanism 90 (S11). With this, the ink (thickened ink) in the recording heads 15 is suctioned from the nozzles 16 via the cap members 92 by the draining pump 96, and the ink is drained from the recording heads 15 (S12). The drained ink is reserved in the waste liquid tank 98 via the ink draining path 97.

Right after the draining operation, or at the same time with the draining operation, the ink is supplied from the ink main tank 73 to the ink sub-tank 72 by the pump 78 (S13). Then, the ink is supplied from the ink sub-tank 72 to the in-head ink tank 71 using a water head difference (S14). Such a circulation operation is continuously performed until a predetermined period has passed (S15).

The method of draining the ink is not limited to that explained with reference to FIG. 19, and the ink may be discharged by applying a specific drive waveform. For example, each of the recording heads 15 may perform an empty discharging by which the ink is discharged while the cap member 92 is being engaged to the respective recording heads and the cap member 92 may function as a receiver for receiving the ink discharged by the recording head 15, in the ink draining and refilling operation.

The wipers 93 clean the recording heads 15, respectively, by wiping the ink flown out from the recording heads 15 at the spaced position, by such an operation of retaining each of the cap members 92 at a negative pressure, or by the empty discharging.

Then, when either of the recovery operations (ink sedimentation dissolving operations) is finished and a printing operation is to be started, the engaging unit 91 returns to the home position, the inkjet recording module 8 moves downward to the printing position on the platen 9 and becomes a status in which printing can be performed (the status as illustrated in FIG. 16).

Figure 20:
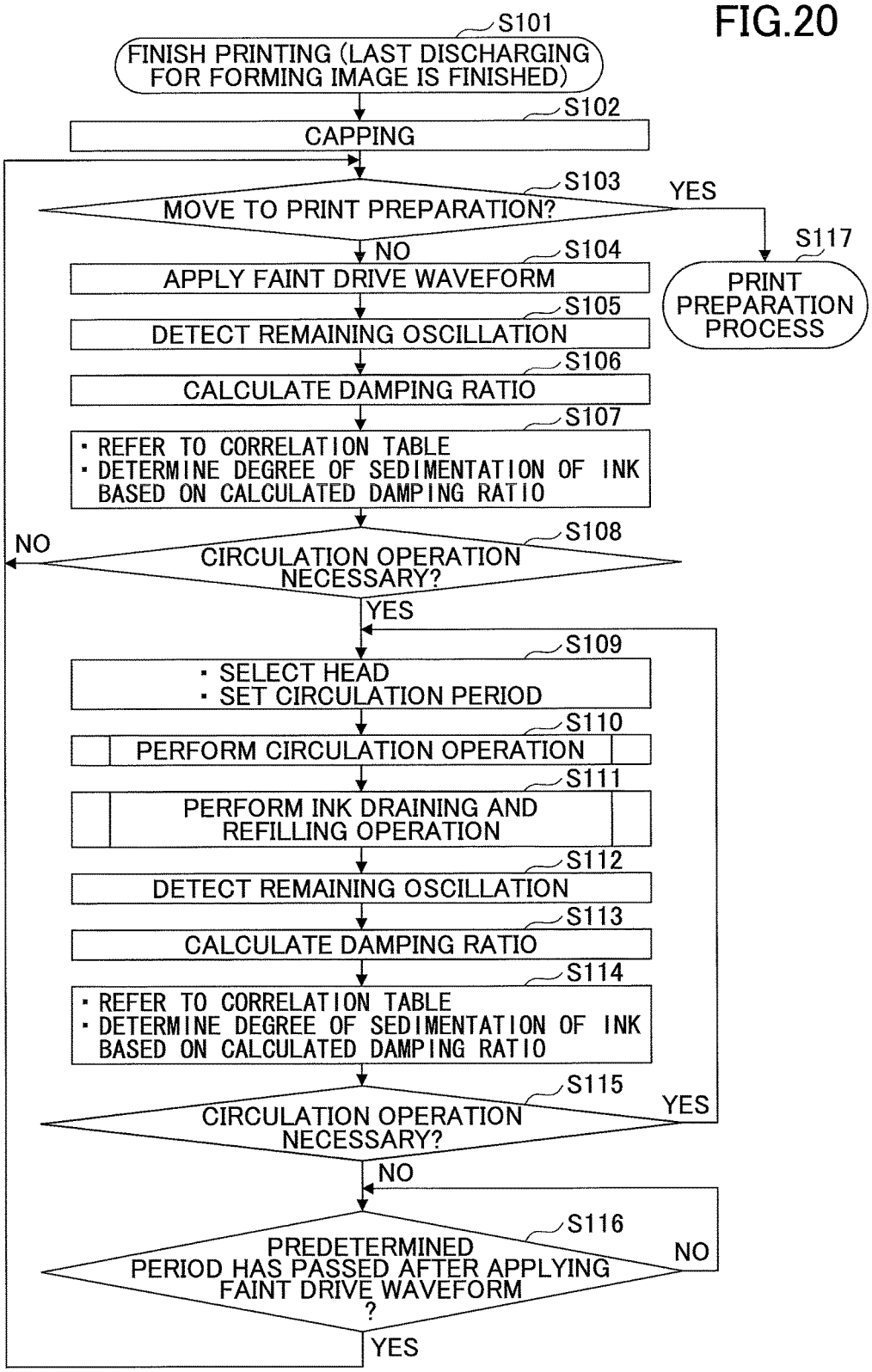
FIG. 20 is a flowchart illustrating an example of a process of detecting the sedimentation of the ink, and performing the maintenance and recovery operation.
Figure 21:
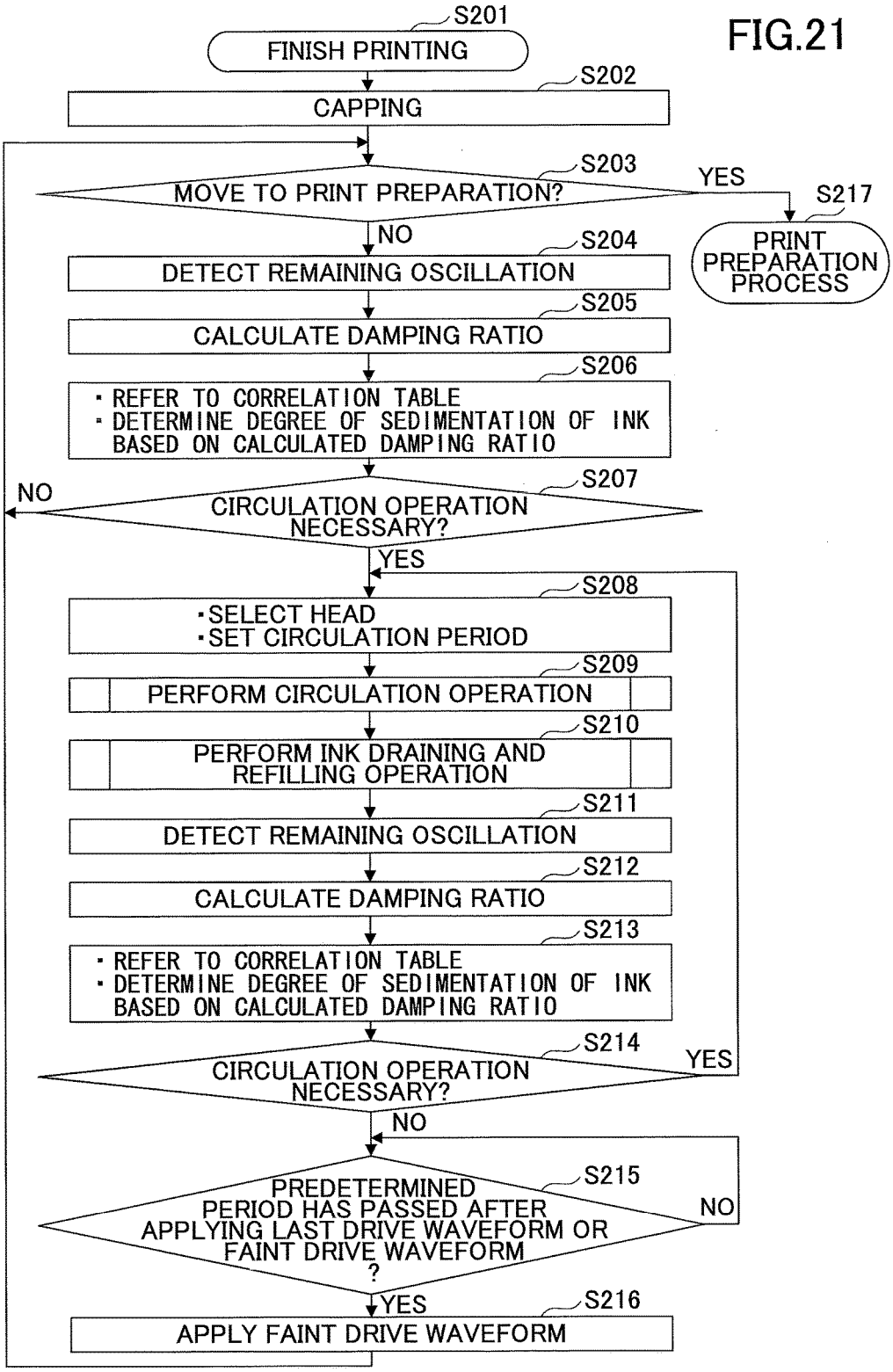
FIG. 21 is a flowchart illustrating another example of a process of detecting the sedimentation of the ink, and performing the maintenance and recovery operation.

FIG. 20 is a flowchart illustrating an example of a process in which sedimentation of the ink is detected, the sedimentation status is determined and dissolved (recovered). Here, the flowchart of determining the sedimentation status of the ink pigment and performing the maintenance and recovery operation of the embodiment is described below.

The circulation control unit 87 controls the circulation module (the circulation unit 70, the ink supplying unit (73, 78, 76) and the maintenance and recovery mechanism 90) based on the determined result of the status of the liquid chamber (degree of sedimentation of ink) to perform the process of FIG. 20.

Right after a printing operation is finished, in other words, discharging of the ink from the recording head 15 is finished, the maintenance and recovery mechanism 90 moves from a home position to a maintenance position, and caps the nozzle surface 17 in order to prevent drying of the nozzles 16 (step S102).

As this capping status is continued until a print preparation instruction from an upper control apparatus, not illustrated in the drawings, is received, whether to continue the capping status is determined in step S103. When printing is restarted (YES of step S103), the cap member 92 departs from the recording head 15 (head array 14), and the maintenance and recovery mechanism moves to the home position to wait for the next printing, as a print preparation process (S117).

When the print preparation is not restarted (NO in step S103), the capping operation is continued.

Next, while capping, a drive waveform signal by which droplet is not discharged (faint drive waveform) is applied to all of the nozzles 16 of each of the recording heads 15 (step S104). As the faint drive waveform does not discharge the droplet, ink consumption and the power consumption can be suppressed. By applying the faint drive waveform to all of the nozzles 16, it is possible to confirm the statuses of the individual pressure generation chambers 20 of all of the nozzles 16 when detecting the remaining waveform later.

Alternatively, applying of the faint drive waveform may be performed only for arbitrarily selected nozzles 16. In this case, the remaining waveform may be detected only for each of these selected nozzles 16. In such a case, a period necessary for the detection can be shortened. Thus, in accordance with necessity, the setting for the detection may be changed.

Here, in this example, an example is described in which the remaining oscillation is detected by applying the faint drive waveform in S104, however, the remaining oscillation may be detected by a waveform by which droplet is discharged, and then, the ink collected in the cap member 92 may be drained (empty discharging may be performed).

Alternatively, without applying the faint drive waveform for detecting the remaining oscillation, the remaining oscillation may be detected right after the image forming is finished using the last drive waveform used in printing.

FIG. 20 is a flowchart illustrating another example of a process in which sedimentation of the ink is detected, the sedimentation status is determined and dissolved (recovered). The difference from FIG. 20 is that applying of the faint drive waveform (or empty discharging waveform) of S104 is not performed, and the remaining oscillation that is generated by the last drive waveform used in printing is detected. Other than this, the processes are the same as those of FIG. 20 and the explanations are not repeated.

Referring back to FIG. 19, in step S105, the remaining oscillation generated by the faint drive waveform is detected. As the remaining oscillation is detected after capping the nozzles 16 in S102, the remaining oscillation detection unit 400 detects the remaining oscillation while the nozzles 16 are capped by the cap member 92. Thus, thickening of the ink at the nozzle portion can be prevented during the maintenance and recovery operation of the circulation, the sedimentation status can be accurately determined.

Here, the remaining oscillation may be obtained from one of the piezoelectric elements that discharge droplets, respectively. Alternatively, the remaining oscillation may be obtained from a piezoelectric element that is provided for a purpose as a supporting column or from an oscillation detection sensor, provided near other piezoelectric elements that discharge droplets, respectively. By detecting the remaining oscillation from such a piezoelectric element or the like, the remaining oscillation may be detected without influencing the discharging operation.

Next, the damping ratio $\zeta$ is calculated based on the remaining oscillation voltage detected in step S105 (step S106). The damping ratio $\zeta$ may be calculated for a plurality of times.

Next, by referring to the correlation table as illustrated in the above described Table 1, the degree of sedimentation of ink (ink viscosity) is calculated from the calculated damping ratio $\zeta$ (S107), and which of the maintenance and recovery operation is to be performed is determined (S108).

Specifically, as about few hundreds of nozzles 16 are mounted on each of the recording heads 15, the average value of the damping ratios $\zeta$ may be calculated for all of the nozzles 16 or each of a plurality of groups. Then, by comparing the average value with the previously prepared look-up-table (Table 1 or the like), whether to perform each of the maintenance and recovery operations of the ink is determined, and when performing the operation, the period for performing the operation is determined. By averaging the damping ratios $\zeta$ calculated from the plurality of nozzles 16, abnormal values such as noises or the like can be eliminated.

Here, as described in Table 1, when the degree of sedimentation of ink $\mu_B$ is greater than or equal to the threshold $\mu_{REF}$, the set periods for the circulation and refill draining are determined by referring to Table 2 (S109).

TABLE 2

| No. | DAMPING RATIO | DEGREE OF SEDIMENTATION OF INK (INK VISCOSITY) | PERIOD OF CIRCULATION OPERATION | PERIOD OF INK DRAINING AND REFILLING OPERATION |
|---|---|---|---|---|
| B1 | $\xi_{B1}$ (SMALL) | $\mu_{B1}$ (SMALL) ($\geq\mu_{REF}$) | $t_1$ (SHORT) | $t_\alpha$ (SHORT) |
| B2 | $\xi_{B2}$ | $\mu_{B2}$ | $t_2$ | $t_\beta$ |
| B3 | $\xi_{B3}$ (LARGE) | $\mu_{B3}$ (LARGE) | $t_3$ (LONG) | $t_\gamma$ (LONG) |

As can be understood from Table 2, the larger the damping ratio $\zeta$ is and the higher the viscosity of the ink is, the more the ink is sedimented and the more difficult to be discharged from the nozzle. Thus, the circulation of the ink and the ink draining and refilling operation are performed for relatively long periods, respectively, when the damping ratio $\zeta$ is large.

As another example, a maximum value of the damping ratio $\zeta$ may be calculated from all of the nozzles 16 or each of the plurality of groups, and the maximum value may be compared with the look-up-table. Further, when the periods for the circulation are not set for the plurality of degrees of sedimentation of ink $\mu_B$, as illustrated in Table 2, the period for the circulation may be set based on whether the damping ratio $\zeta$ exceeds predetermined threshold or not. Further, instead of the average value, a value corresponding to a root mean square value may be used.

As such, conditions of the circulation operation of the ink and the ink draining and refilling operation can be determined by comparing the detected damping ratio (may be an average value, a maximum value or a root mean square value of a plurality of damping ratios), and previously generated table data, the recovery operation (ink sedimentation dissolving operation) can be determined in detail for each of the degrees of sedimentation of ink or the like by a simple method.

Further, the damping ratio $\zeta$ is calculated and the degree of sedimentation of ink is determined by referring to the table, for each of the recording heads 15 of each of the head arrays 14K, 14C, 14M and 14Y. Thus, the head array 15 for which it is necessary to perform the circulation operation and the draining and refilling operation is selected (S109).

Here, conditions of the circulation operation and the draining and refilling operation may be changed for each of the recording heads 15, or each of the groups of the recording heads 15 (each of head arrays 14K, 14M, 14C and 14Y (each of groups of colors (recording heads 15 in a lateral direction of FIG. 3), or each of groups of recording heads 15 in a lateral direction of FIG. 3, for example). By setting as such, an optimal ink sedimentation dissolving operation can be performed for each of the recording heads 15, or each of groups of recording heads 15 and running cost can be suppressed.

Here, the selection of the recording head 15 or the group of recording heads 15 to which the ink circulation operation and the ink draining and refilling operation are performed, and the period for the draining and refilling operation are set at a timer or the like by the circulation control unit 87 (step S109).

Then, as described above with reference to FIG. 18, a circulation operation (liquid circulation operation) in which the ink is circulated between the ink sub-tank 72 and the in-head ink tank 71 is performed (step S110). With this operation, the sedimentation status of the ink pigment (component in the liquid) can be dissolved.

After performing the ink circulation operation, the ink draining and refilling operation (liquid draining and refilling operation), described above in detail with reference to FIG. 19, is performed (S111).

After performing the circulation operation and the draining and refilling operation, a faint drive waveform (or an empty discharging waveform) is applied again to detect the remaining oscillation (S112). At this time, applying of the faint drive waveform and the detection of the remaining oscillation may be performed for all of the nozzles 16 or for the arbitrarily selected nozzles 16, and may be the same as the nozzles 16 to which the faint drive waveform is detected in S104, or may be selected from the nozzles 16 to which the faint drive waveform is detected in S104.

Then, the damping ratio $\zeta$ is calculated by the detected remaining oscillation (S113). Then, a degree of sedimentation of ink is determined by calculating the viscosity of the ink and the ink concentration by referring to the correlation table based on the calculated damping ratio $\zeta$ (S114). Thus, by detecting the remaining oscillation again, whether the sedimentation status of the ink pigment or the like of the ink in the individual pressure generation chamber 20 is dissolved or not can be confirmed.

Then, whether it is necessary to perform the circulation operation is determined based on the degree of sedimentation of ink (S115). When the sedimentation of the ink pigment is observed yet, and it is necessary to perform the circulation operation again, the process returns back to step S109, and the same processes are performed.

When the sedimentation of the ink pigment is not detected in S115, and it is unnecessary to perform the circulation operation again, after a predetermined period (about a few minute, for example) has passed (S114, S215), the process returns back to step S103 (or S203), and the same processes are performed. The predetermined period is not limited to a few minute. For example, it is desirable that the predetermined period is sufficient short with respect to the change of the ink characteristics.

As such, according to the embodiment, by detecting the remaining oscillation, the sedimentation status of the ink pigment in various sedimentary inks can be accurately determined.

Further, according to the embodiment, as illustrated in Table 1 and Table 2, as conditions such as whether to perform each of the circulation operation and the ink draining and refilling operation and the period for each of the operations are determined based on the degree of sedimentation calculated by detecting the remaining oscillation, the electrical energy consumption and the ink consumption (running cost) can be suppressed in the maintenance and recovery operation (capping, ink sedimentation dissolving operation).

Further, according to the embodiment, even when the viscosity is changed in the sedimentary ink, an appropriate maintenance and recovery operation is performed. Thus, printing failure due to lowering of discharging characteristics, or lowering of image quality due to ununiformed concentration can be prevented.

According to the embodiment, a droplet discharging apparatus capable of detecting a sedimentation status of ink pigment in various sedimentary inks, and reducing electrical energy consumption and ink consumption is provided.

Although a preferred embodiment of the droplet discharging apparatus, the method of controlling the droplet discharging apparatus and the image forming apparatus including the droplet discharging apparatus has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

The present application is based on and claims the benefit of priority of Japanese Priority Application No. 2015-056819 filed on Mar. 19, 2015, the entire contents of which are hereby incorporated by reference.

What is claimed is:

1. A droplet discharging apparatus comprising:

a recording head that includes a plurality of pressure chambers that communicate with a plurality of nozzles, respectively, each of the pressure chambers reserving liquid, an oscillation plate provided over the pressure chambers to form an elastic wall of each of the pressure chambers, a plurality of piezoelectric elements provided to face the pressure chambers, respectively, via the oscillation plate, and an in-head reservoir, provided near the pressure chambers, that supplies liquid to the pressure chambers;

a liquid circulation unit that includes a liquid reservoir that reserves liquid, and a liquid transporting pipe that transports liquid between the in-head reservoir of the recording head and the liquid reservoir, the liquid circulation unit circulating liquid between the in-head reservoir and the liquid reservoir;

a drive waveform generation unit that generates a drive waveform that drives each of the piezoelectric elements;

a remaining oscillation detection unit that detects remaining oscillation generated in at least one of the pressure chambers after driving the respective piezoelectric element;

a status determining unit that determines a sedimentation status of a component in liquid in the in-head reservoir based on the remaining oscillation detected by the remaining oscillation detection unit; and a control unit that controls a liquid circulation operation of the liquid circulation unit in order to dissolve the sedimentation status of the component in the liquid in the in-head reservoir based on the sedimentation status determined by the status determining unit, wherein the remaining oscillation detection unit detects a plurality of amplitude values of the plurality of cycles of the same remaining oscillation generated in the pressure chamber, respectively, after driving the piezoelectric element, and calculates a damping ratio using at least two amplitude values selected from the plurality of amplitude values, wherein the status determining unit determines the sedimentation status of the liquid in the in-head reservoir based on the damping ratio, and wherein the status determining unit determines that a degree of sedimentation becomes larger as the damping ratio increases.

2. The droplet discharging apparatus according to claim 1, wherein the remaining oscillation detection unit detects a remaining oscillation that is generated by applying a faint drive waveform by which droplet is not discharged from the pressure chamber, and wherein the status determining unit determines the sedimentation status of the liquid in the in-head reservoir based on an output of the remaining oscillation generated by the faint drive waveform.

3. The droplet discharging apparatus according to claim 1, wherein the remaining oscillation detection unit is configured to be capable of detecting the remaining oscillation of each of the plurality of pressure chambers.

4. The droplet discharging apparatus according to claim 1, wherein the remaining oscillation detection unit selects at least one of the plurality of pressure chambers and detects the remaining oscillation of the selected pressure chamber.

5. The droplet discharging apparatus according to claim 3, wherein the remaining oscillation detection unit detects, for each of two or more of the pressure chambers, a plurality of amplitude values of the plurality of cycles of the remaining oscillation generated in the respective pressure chamber, respectively, after driving the respective piezoelectric element, and calculates a damping ratio based on the plurality of amplitude values for the respective pressure chambers, and wherein the status determining unit determines the sedimentation status of the liquid in the in-head reservoir based on an average value of the damping ratios obtained for the two or more of the pressure chambers.

6. A method of controlling a droplet discharging apparatus including a recording head that includes a plurality of pressure chambers that communicate with a plurality of nozzles, respectively, each of the pressure chambers reserving liquid, an oscillation plate provided over the pressure chambers to form an elastic wall of each of the pressure chambers, a plurality of piezoelectric elements provided to face the pressure chambers, respectively, via the oscillation plate, and an in-head reservoir, provided near the pressure chambers, that supplies liquid to the pressure chambers, a liquid circulation unit that includes a liquid reservoir that reserves liquid, and a liquid transporting pipe that transports liquid between the in-head reservoir of the recording head and the liquid reservoir, the method comprising:

generating a drive waveform to drive at least one of the piezoelectric elements;

detecting remaining oscillation that is generated in the respective pressure chamber after driving the piezoelectric element, the detecting including, detecting a plurality of amplitude values of the plurality of cycles of the same remaining oscillation generated in the pressure chamber, respectively, after driving the piezoelectric element, and calculating a damping ratio using at least two amplitude values selected from the plurality of amplitude values;

determining a sedimentation status of liquid in the in-head reservoir based on the damping ratio in which determining a degree of sedimentation becomes larger as the damping ratio increases; and controlling a liquid circulation operation of the liquid circulation unit in order to dissolve the sedimentation status of a component in the liquid in the in-head reservoir based on the determined sedimentation status.

7. An image forming apparatus comprising:

the droplet discharging apparatus according to claim 1;

a liquid supplying unit that supplies liquid to the liquid reservoir of the liquid circulation unit;

a maintenance and recovery unit that includes a cap member capping the plurality of nozzles and a liquid draining mechanism that causes the cap member to be a negative pressure, and performs a maintenance and recovery operation of the nozzle based on the sedimentation status of the component in the liquid in the in-head reservoir, wherein the control unit of the droplet discharging apparatus controls the liquid circulation operation of the liquid circulation unit and the maintenance and recovery operation of the maintenance and recovery unit in order to dissolve the sedimentation status of the component in the liquid in the in-head reservoir based on the sedimentation status determined by the status determining unit.

8. The image forming apparatus according to claim 7, wherein after the liquid circulation operation of the liquid circulation unit is performed, the control unit controls to perform a liquid draining and refilling operation in which the liquid draining mechanism of the maintenance and recovery unit causes the cap member to be a negative pressure to drain the liquid in the nozzles by suctioning the nozzles, and the liquid supplying unit supplies the liquid to the liquid reservoir, based on the sedimentation status of the component in the liquid, wherein after performing the liquid draining and refilling operation, the drive waveform generation unit generates a drive waveform that drives the piezoelectric element, and the remaining oscillation detection unit detects remaining oscillation generated in the respective pressure chamber after driving the piezoelectric element, and wherein the status determining unit determines whether the sedimentation status of the component in the liquid in the in-head reservoir is dissolved based on an output detected by the remaining oscillation detection unit after performing the liquid draining and refilling operation.

9. The image forming apparatus according to claim 7, wherein the remaining oscillation detection unit detects the remaining oscillation while the nozzles are capped by the cap member.

10. The droplet discharging apparatus according to claim 1, wherein the remaining oscillation detection unit detects an "n" th amplitude value of an "n" th cycle of the remaining oscillation, and an "n+m" th amplitude value of an "n+m" th cycle of the same remaining oscillation, the "n+m" th cycle being later than the "n" cycle, each of "n" and "m" being a natural number, and calculates a damping ratio using at least the "n" th amplitude value and the "n+m" th amplitude value.

11. The droplet discharging apparatus according to claim 10, wherein the remaining oscillation detection unit calculates the damping ratio using logarithmic decrement of the "n" th amplitude value with respect to the "n+m" th amplitude value.

12. The droplet discharging apparatus according to claim 1, wherein the remaining oscillation detection unit calculates the damping ratio without using a first amplitude value of a first cycle, which is the earliest among the plurality of cycles of the plurality of cycles of the same remaining oscillation, and using at least the two amplitude values of second or later cycles, which are later than the first cycle, of the same remaining oscillation.

13. The method of controlling according to claim 6, wherein in the detecting, an "n" th amplitude value of an "n" th cycle of the remaining oscillation, and an "n+m" th amplitude value of an "n+m" th cycle of the same remaining oscillation are detected, and a damping ratio is calculated using at least the "n" th amplitude value and the "n+m" th amplitude value, the "n+m" th cycle being later than the "n" cycle, each of "n" and "m" being a natural number.

14. The method of controlling according to claim 13, wherein in the calculating in the detecting, the damping ratio is calculated using logarithmic decrement of the "n" th amplitude value with respect to the "n+m" th amplitude value.

15. The method of controlling according to claim 6, wherein in the detecting, the damping ratio is calculated without using a first amplitude value of a first cycle, which is the earliest among the plurality of cycles of the plurality of cycles of the same remaining oscillation, and using at least the two amplitude values of second or later cycles, which are later than the first cycle, of the same remaining oscillation.

* * * * *